US011607684B2

(12) United States Patent
Le Berre

(10) Patent No.: US 11,607,684 B2
(45) Date of Patent: Mar. 21, 2023

(54) MICROFLUIDIC SAMPLE CHIP, ASSAY SYSTEM USING SUCH A CHIP, AND PCR METHOD FOR DETECTING DNA SEQUENCES

(71) Applicant: BFORCURE, Paris (FR)

(72) Inventor: Maël Le Berre, Paris (FR)

(73) Assignee: BFORCURE, Paris (FR)

( * ) Notice: Subject to any disclaimer, the term of this patent is extended or adjusted under 35 U.S.C. 154(b) by 0 days.

(21) Appl. No.: 17/548,591

(22) Filed: Dec. 12, 2021

(65) Prior Publication Data

US 2022/0097049 A1 Mar. 31, 2022

Related U.S. Application Data

(62) Division of application No. 16/471,500, filed as application No. PCT/EP2017/082908 on Dec. 14, 2017, now abandoned.

(30) Foreign Application Priority Data

Dec. 19, 2016 (FR) ..... 16 01823
Dec. 13, 2017 (FR) ..... 17 62058

(51) Int. Cl.
*C12N 15/10* (2006.01)
*B01L 3/00* (2006.01)
(Continued)

(52) U.S. Cl.
CPC ... *B01L 3/502707* (2013.01); *B01L 3/502715* (2013.01); *B01L 7/52* (2013.01);
(Continued)

(58) Field of Classification Search
CPC ..... B01L 3/502707; B01L 3/502715; B01L 7/52; B01L 2300/0816; B01L 2300/0864;
(Continued)

(56) References Cited

U.S. PATENT DOCUMENTS 5,508,197 A 4/1996 Hansen et al.
5,637,469 A 6/1997 Wilding et al.
(Continued)

FOREIGN PATENT DOCUMENTS

CN 102994369 A 3/2013
EP 2 415 855 A1 2/2012
(Continued)

OTHER PUBLICATIONS

Pavsic et al. ("Assessment of the real-time PCR and different digital PCR platforms for DNA quantification." Analytical and bioanalytical chemistry 408.1 (2015): 107-121). (Year: 2015).*
(Continued)

*Primary Examiner* — Jennifer Wecker
*Assistant Examiner* — Oyeleye Alexander Alabi
(74) *Attorney, Agent, or Firm* — Im IP Law; Chai Im; C. Andrew Im

(57) ABSTRACT

A microfluidic sample chip to test biological samples, especially for a PCR-type and/or fluorescence assay. The chip being in the shape of a hollow block having at least one chamber delimited by an upper wall, a lower wall and at least one side wall, into which a sample can be introduced for testing. The lower wall of the block is made of a material with a high thermal conductivity and the upper wall is made of a material with a low thermal conductivity. Preferably, the upper wall is preferably permeable to radiation in the visible spectrum between 400 and 700 nm. The block having at least two openings through which the sample can be introduced into at least one of the chambers and through which the air present in the chamber can be evacuated when the sample is introduced.

20 Claims, 10 Drawing Sheets

(51) Int. Cl.
*B01L 7/00* (2006.01)
*F28F 3/12* (2006.01)

(52) U.S. Cl.
CPC ..... *F28F 3/12* (2013.01); *B01L 2300/0816* (2013.01); *B01L 2300/0864* (2013.01); *B01L 2300/185* (2013.01); *B01L 2400/0655* (2013.01); *F28F 2260/02* (2013.01)

(58) Field of Classification Search
CPC ..... B01L 2300/185; B01L 2400/0655; F28F 3/12; F28F 2260/02
See application file for complete search history.

(56) References Cited

U.S. PATENT DOCUMENTS

| | | | | |
|---|---|---|---|---|
| 5,958,349 | A | 9/1999 | Petersen et al. | |
| 6,143,496 | A | 11/2000 | Brown et al. | |
| 9,453,255 | B2 | 9/2016 | Ozawa et al. | |
| 2006/0188979 | A1 | 8/2006 | Spaid et al. | |
| 2007/0172389 | A1* | 7/2007 | Wilding | B01L 7/52 422/400 |
| 2007/0254379 | A1* | 11/2007 | Kim | B01L 3/502738 264/483 |
| 2013/0121893 | A1* | 5/2013 | Delamarche | B01L 3/502746 422/503 |
| 2014/0255933 | A1 | 9/2014 | Ozawa et al. | |

FOREIGN PATENT DOCUMENTS

| | | | |
|---|---|---|---|
| EP | 2 787 067 | A1 | 10/2014 |
| WO | 0177641 | A1 | 10/2001 |
| WO | 2009029845 | A1 | 3/2009 |
| WO | 2009/105499 | A1 | 8/2009 |
| WO | 2011/138748 | A1 | 11/2011 |
| WO | 2015/138343 | A1 | 9/2015 |
| WO | 2016170126 | A1 | 10/2016 |

OTHER PUBLICATIONS

Houssin et al., "Ultrafast, sensitive and large-volume on-chip real-time PCR for the molecular diagnosis of bacterial and viral infections," Lab Chip, Mar. 2016, pp. 1401-1411, vol. 16, No. 8, The Royal Society of Chemistry.
Wheeler et al., "Under-three minute PCR: Probing the limits of fast amplification," Analyst, Jul. 27, 2011, pp. 3707-3712, vol. 136, Issue 18, The Royal Society of Chemistry.
Zongh et al., "Multiplex digital PCR: breaking the one target per color barrier of quantitative PCR," Lab Chip, May 17, 2011, pp. 2167-2174, vol. 11, , No. 13, The Royal Society of Chemistry.
Huggett et al., "The Digital MIQE Guidelines Minimum Information for Publication of Quantitative Digital PCR Experiments," Clinical Chemistry, 2013, pp. 892-902, vol. 59, No. 6.
Jena et al., "Cyclic olefin copolymer based micro-fluidic devices for biochip applications: Ultraviolet surface grafting using 2-methacryloyloxyethyl phosphorycholine," Biomicrofluidic, Mar. 2012, pp. 012822-1 to 012822-12, vol. 6, No. 1.
Elvesys, "Microfluidics and microfluidic devices: A Review," www.eleveflow.com, Published 2022.

* cited by examiner

MICROFLUIDIC SAMPLE CHIP, ASSAY SYSTEM USING SUCH A CHIP, AND PCR METHOD FOR DETECTING DNA SEQUENCES

RELATED APPLICATIONS

This application is a divisional of application Ser. No. 16/471,500 filed Jun. 19, 2019, which is a § 371 application from PCT/EP2017/082908 filed Dec. 14, 2017, which claims priority from French Application No. 16 01823 filed Dec. 19, 2016, and French Application No. 17 62058 filed Dec. 13, 2017, each of which is herein incorporated by reference in its entirety.

FIELD OF THE INVENTION

According to a first aspect, the invention relates to a micro-fluidic chip for thermalization with variable temperature cycles, said chip being formed of a block of material in which there is a cavity that can contain at least one fluid, this cavity comprising at least one inlet orifice and at least one outlet orifice, the fluid inlet orifice being connected to at least two fluid injection channels.

According to this first aspect, it also relates to a system using such a thermalization chip for the rapid change in heat exchange temperature with a sample containing DNA as well as a polymerase chain reaction (PCR) method for the detection of DNA sequences in a sample.

According to a second aspect, the invention also relates to a micro-fluidic sample chip for the test of biological samples, in particular for a PCR and/or fluorescence type analysis, having the shape of a hollow block comprising at least one chamber delimited by an upper wall, a lower wall and at least one side wall, into which a sample to be tested can be introduced.

According to this second aspect, it also relates to an analysis system for a PCR type sample contained in a chamber in a sample chip, as well as a PCR method for detecting DNA sequences using the chip and the system for a fluorescence measurement of the sample.

BACKGROUND OF THE INVENTION

According to the first aspect, a detailed state of the art relating to the various methods and devices for detecting DNA sequences in a liquid sample by using a reaction requiring repeated temperature cycles (hereinafter referred to as thermal "cycling" of DNA samples for carrying out a "Polymerase chain reaction" or more simply "thermal cycling") is described for example in Patent Application WO 2009/105499A1.

Among these thermal cycling methods, some advantageously use a heat transfer liquid circulating near the sample in order to control the temperature thereof. The use of a heat transfer liquid makes it possible to obtain a very homogeneous thermalization temperature for the sample, because the convection limits the appearance of temperature gradients in the liquid, unlike solutions based on local heating or local heat pumping with a thermoelectric element, which can locally create temperature gradients. The use of a heat transfer liquid also allows a very effective heat transfer to the sample because it only depends on the thermal proximity of the sample with the heat transfer liquid and the coefficient of convection of the heat transfer liquid which can be very important when this liquid is transported in pipes of small sizes (micro-fluidic channels). Furthermore, the use of a heat transfer liquid makes it possible to quickly obtain an accurate and uniform temperature control for a sample having a large volume (superior to one microliter) for, whatever the size thereof, the temperature of the sample quickly tends towards the temperature of the heat transfer liquid when placed nearby, unlike the systems based on the injection of thermal energy such as joule effect heating for which it is difficult to homogenously control the temperature only from the control of the power injected.

U.S. Pat. No. 5,508,197A describes the thermalization of wells having very thin walls and containing PCR samples by causing the heat transfer liquids, previously "thermalized" (i.e. brought to a precise and homogenous temperature) at various temperatures to successively circulate around the wells by using a series of valves which redirect the liquids from thermalized tanks to several samples. This system, which allows a change in the sample temperature in about 8 seconds, has a limited speed due to the transfer of heat through the wells and the volume of 15 μl of the sample, whose geometry and size do not allow a faster transfer. In this system, the volume of liquid used for thermalizing the samples is important (~150 mL), so that the liquid flow rates are important (~10 L/min), the liquid volumes in the tanks must be important (~25 L) to ensure a good temperature stability. These volume constraints make the system bulky and very energy intensive. In addition, such a system is difficult to transport because of its size.

EP 2415855A1 describes a PCR reaction by successively circulating two heat transfer liquids at different temperatures for thermalizing a sample in a well made from a thin aluminum sheet, allowing thereby to obtain, with wells having a flattened shape, very fast changes in temperature (up to 0.3 s). The volumes of liquid used in this system remain significant, of about several tens of millimeters, as well as the flow rate (more than 60 mL/min), still making thereby a cumbersome and energy intensive system.

WO 2011/138748A1 describes a micro-fluidic chip and a system for regulating the temperature of a sample comprising a plurality of micro-fluidic channels arranged at the bottom of a cavity having a parallelepiped shape and comprising a lower wall of low thermal conductivity to avoid heat losses during its use and an upper wall of high thermal conductivity on which is deposited a sample to be analyzed, allowing thereby a good heat exchange between the heat transfer liquid circulating in the channels and the sample.

The heat transfer liquid is injected through an inlet orifice into the micro-fluidic channels and recovered through an outlet orifice at the other end of the micro-fluidic channels. The temperature of the heat transfer liquid is regulated upstream of the inlet orifice outside and away from the chip. An example of a method for manufacturing a chip of this type is described on the website of the company ELVESYS at www.elveflow.com in the article entitled "microfluidics and microfluidic devices: A Review".

This type of chip has been used by the authors Houssin et al. of an article published in 2016 "The royal society of chemistry 2016" with the title "Ultrafast sensor and large volume on-chip real time PCR for the molecular diagnosis of bacterial and viral infections" in which they describe the implementation of a heat "cycling" method to carry out a PCR reaction that is not entirely satisfactory: the change in temperature of the sample is achieved by alternately circulating in the micro-fluidic chip, containing a heat exchange zone with the sample, two heat transfer liquids which have been beforehand thermalized by using two thermoelectric modules (Peltier effect device). The thermal exchange between the chip and the sample enables to carry out this alternation of temperature of the liquid sample, making it possible thereby to amplify a DNA sequence in the sample.

If this system enables to carry out rapid thermalizations (also of about 2 s) with a low liquid flow rate (of about 10 mL/min or 160 μL/s), the performance of this system remains limited by the volume and the thermalization of the pipes supplying the chip. Indeed, when the liquid does not flow in the chip, the temperature of the pipes (the diameter of a micro-fluidic pipe varies from one micron to several hundred microns), which have a small volume and therefore a low thermal inertia, tends in a few seconds towards the room temperature. When the liquid circulates again, one have first to evacuate all the liquid at a temperature close to the room temperature which is in the pipe (which takes according to the experiments conducted by the inventors about 0.5 seconds), then thermalize the pipe, that is to say bring it to a stable temperature, which takes according to the experiments conducted by the inventors from a few seconds to a few tens of seconds. Before reaching this stability, the temperature of the liquid injected into the chip is disturbed by the transfer of heat to the pipe. Thus, it takes about two seconds to achieve 95% of the desired change in temperature but a temperature drift of up to several degrees is observed over a longer time according to the conditions, typically of about ten seconds. As this temperature drift is not reproducible because it depends on the temperature of the pipe before the imposed change in temperature, it is not thus possible to obtain with this system a fast and accurate control of the temperature of a sample with small flow rates allowing the miniaturization of the system and thus making it easily transportable.

US 2006/0188979A1 discloses a system for simultaneously reacting a plurality of reagents with the sample, in a plurality of parallel channels at the same temperature, the number of channels being equal to the number of reagents intended to be used in this system.

The various solutions proposed in the prior art for rapid change in temperature by using heat transfer liquids do not therefore enable at present a control of the temperature of a sample (i.e. in less than about five seconds), which is rapid, accurate, homogeneous, reproducible and low energetic and which uses a compact equipment.

Nevertheless, the current needs of rapid tests for orienting the diagnostic require reactions such as PCR of few minutes in a light and low energetic device, which can possibly operate on-site, i.e. which has a small size on the one hand and which can be possibly be powered by a battery on the other hand.

As a PCR-type analysis requires between 30 and 40 temperature cycles, the minimum duration for each cycle being of about 8 s, each second gained over the duration of the change in temperature of the sample is a significant gain on the total duration e of this type of test.

Moreover, the complexity of PCR-based molecular detection kits, especially for multiplex detection, imposes a precise control of the temperatures at the different phases of the cycle in order to operate properly.

OBJECT AND SUMMARY OF THE INVENTION

The micro-fluidic thermalization chip, the system and method according to the first aspect of the invention allows to solve the problem thus posed.

The micro-fluidic thermalization chip according to the invention is formed by a block of material in which are arranged successively:

a fluid injection zone comprising at least one micro fluidic channel for a fluid injection, a parallelepiped-shaped cavity having an upper side comprising a heat exchange zone provided with a thermalization zone of surface S at the upper side of the cavity, the thermalization zone comprising at least one micro-fluidic channel for the fluid circulation, this cavity being provided with at least one fluid inlet orifice from the fluid injection zone and at least one fluid outlet orifice, between which the heat exchange zone extends, characterized in that it preferably comprises a single fluid inlet orifice, preferably one fluid outlet orifice, and further at least one micro-fluidic channel for bypassing the cavity, connected at a first end to at least one of the micro-fluidic channels for the fluid injection, the junction of the bypass channel at the fluid injection channel being at a distance L from the fluid inlet orifice of the cavity, the distance L between each junction and the fluid inlet orifice being as:

$$L<S/a$$

S being the surface of the thermalization zone of the upper side of the cavity expressed in $m^2$ a being a correction coefficient equal to 0.005 m.

Preferably, L will be less than or equal to 0.02 m, while each fluid injection channel will preferably be connected to at least one bypass channel.

The chip will preferably comprise at least two micro-fluidic fluid injection channels.

According to a preferred embodiment, the chip will have the same number, preferably two, of injection channels and bypass channels, each bypass channel being connected to a single injection channel.

Advantageously, the cavity will comprise a plurality of fluid circulation channels arranged in parallel to prevent the formation of bubbles.

In another embodiment the chip is characterized in that the cavity further comprises an input homogenization zone between the inlet orifice and the fluid inlet into the micro-fluidic fluid circulation channels corresponding to the heat exchange zone so as to homogenize in particular the speed of the fluid before injection into the fluid circulation channels.

This input homogenization zone can for example comprise a homogenization tree creating a plurality of flow paths for the fluid between the inlet orifice and the fluid inlet, these paths having substantially the same length.

According to another variant, the chip will be formed by a block of parallelepiped-shaped material whose cavity is closed by an upper plate, integral or independent relative to the lateral sides of the cavity, this plate having an upper side intended to be in contact with the sample and preferably having a thickness less than 0.002 m. The upper plate is either integrated with the chip, or independent and added to the chip during use.

This upper plate can for example made of glass and/or metal.

According to yet another variant, the cavity can further comprise an output homogenization zone in the fluid outlet of the micro-fluidic channels and the fluid outlet orifice of the cavity, so as to homogenize in particular the temperature of the fluid before injection into the fluid outlet orifice.

According to a preferred embodiment, the output homogenization zone will comprise a homogenization tree creating a plurality of flow paths for the fluid between the fluid outlet of the micro-fluidic channels and the fluid outlet orifice of the cavity, these paths having substantially the same length.

Preferably, the thickness of the parallelepiped-shaped cavity will be less than 0.001 m, preferably less than or equal to 500 micrometers.

According to yet another variant, the chip will comprise at least one valve disposed in at least one of its injection and/or bypass channels.

Preferably, a three-way-3/2 dispensing valve is positioned at the inlet of the cavity for switching the source of the liquid entering the cavity between two liquid inlets at different temperatures, while two 2/2-type valves respectively on the two bypass channels enable to close the channels when the liquid of one channel is oriented towards the thermalization area in the cavity. In this configuration, the common way (output) of the 3/2 valve is connected to the inlet of the cavity and the other two ways (inlets) are respectively connected to the fluid injection channels. A dispensing valve having n positions (n being greater than two) associated with n 2/2 valves can be used with the same pattern to switch the source of liquid entering the cavity between the channels.

According to another embodiment, it is possible to use several 3/2-valves positioned at the junction for redirecting the liquid from the injection channels either to the cavity or to the bypass channels. In this configuration, the common way of each 3/2-valve is connected to the corresponding liquid injection channel and the other 2 ways of these same valves are connected to the cavity on the one hand and the corresponding bypass way on the other hand.

Another embodiment aims at positioning 2/2-valves on each of the bypass ways and channel portions between the thermalization area and the junction so as to redirect the liquid injected either into the thermalization area, or into the bypass channels.

Preferably, the valves are integrated into the chip. For this purpose, miniature valves of the type to be mounted on a base (for example valves of LVM09 series of the manufacturer SMC) can be mounted directly on the chip, or pressure or solenoid-controlled valves can be integrated are into the chip in order to minimize the length of the fluid paths between the thermalization area and the junction with the bypass channels.

The invention also relates to a micro-fluidic system comprising a chip as described above, preferably having a first heat conducting film disposed above the cavity and closing it preferably in a sealing manner and on which is fixed, preferably glued, a sample holder for receiving the PCR reagent mixed with the DNA sample to be analyzed.

The film of heat conducting material can be for example disposed at least partially on the flat surface of the chip and maintained, for example under pressure on it, in order to ensure sealing at the heat transfer liquid when in contact with the film.

According to a variant, the sample holder will comprise a second film of heat conducting material, in its lower part, intended to be in contact with the first film.

Preferably, the system according to the invention will also comprise means for circulating at least one heat transfer fluid under pressure in the channels.

According to a preferred embodiment, the system according to the invention will comprise means for circulating a plurality, preferably two, heat transfer liquids at different temperatures in the injection channels and/or the bypass channels and alternately supplying the cavity with the one of these liquids while the other heat transfer liquids, preferably only one, will circulate in the injection channels up to the junction and then in the associated bypass channels.

In general, but however without needing it, the alternate supply of the cavity by different heat transfer liquids will be carried out by varying the respective pressures of the heat transfer liquids.

According to one variant, the alternate supply of the cavity by different heat-transfer liquids will be carried out by means of valves arranged in the different pipes.

The invention also relates to a method for carrying out a PCR type reaction preferably by using the chip described above, with or without the sample holder described above, in which a DNA sample is placed alternately in indirect thermal contact with at least one first and one second heat transfer liquid, at different temperatures, circulating in micro-fluidic channels and alternately supplying a cavity, enabling thereby a heat exchange with the sample, in which method, when one of the liquids is sent to the cavity, the other liquid bypasses the cavity and vice versa, the two liquids alternately entering the cavity through a supply pipe having a junction enabling the liquid to go into either the cavity or to bypass the cavity, the distance between the junction and the inlet of the cavity being less than 0.02 meters.

Preferably, this method will use a thermalization chip and/or a system as described in this application.

In general, the inlet and/or the outlet of the cavity will comprise a pressure equalization network (homogenization tree) at the inlet (and/or at the outlet) of the thermalization zone (exchange of heat with the sample), comprising a series of channel divisions between the inlet and/or outlet orifices and the fluid inlets and/or outlets of the fluid circulation channels so that the path traveled by the fluid between the orifices and/or the fluid inlets/outlets, (thus the resistance to the flow of fluid) is substantially identical over the entire distance between the fluid inlet and/or outlet orifices. This homogenization tree allows a substantially parallel fluid flow with a homogeneous speed over the entire surface S, allowing thereby a uniform convection over the entire exchange surface S, which allows a spatially homogeneous speed, and more precisely a spatially homogeneous kinetics (curve of evolution over time), of the change in temperature.

The material chosen to make the chip can be very varied as soon as the necessary channel network can be created by machining, molding, using a 3D printer, etc. Preferably it can be chosen especially from polymers, such as PDMS or polycarbonate, ceramics, glass and/or a combination thereof.

In a preferred embodiment, the block forming the thermalization chip will comprise at least one cavity whose walls define a plat upper surface onto which a plurality of channels, preferably arranged substantially parallel to each other and forming the cavity, open while, according to an embodiment variant, the flat surface will be surmounted by a thin plate or a film of good heat conducting material, preferably of metal or glass, so as to close the cavity. This plate and/or film will be either integral with the side walls of the cavity or placed on the upper edges of these walls and held under pressure and/or by gravity so as to be movable and separable from the actual chip.

According to another embodiment variant, the chip will comprise at least one valve disposed in at least one of its channels. Preferably, it will comprise a valve for each liquid supply channel and a valve per bypass channel. Of course, these valves are not necessarily integrated in the chip and can be located out of the chip, in the fluid supply pipes or in bypass pipes.

The invention also relates to a micro-fluidic system comprising a chip as described above, a first heat conducting film disposed on the cavity so as to close the latter and a sample holder placed on the film (or plate) for receiving the DNA sample to be analyzed.

According to a first variant, the alternate supply of the cavity by different heat transfer liquids is carried out by varying the respective pressures of the heat transfer liquids. Thus, when heat transfer liquid supply channels meet, before entering the cavity, the liquid having the higher pressure will force the passage to this cavity, or the other liquid(s) being stopped and diverted to the corresponding junction (and the associated bypass channel when these channels exist), allowing their continuous circulation (with or without return to the heat transfer liquid supply tanks). In general, the heat transfer liquid entering the cavity will flow simultaneously in the bypass channel associated therewith, when it exists. In the case only one bypass channel exists and the heat transfer fluid entering the cavity circulates in a supply channel that is not associated with a channel for bypassing the cavity, the heat transfer liquid will stop circulating in this supply channel. It is therefore understood that this solution can be in some cases less efficient than the preferred solution combining a supply channel and a bypass channel.

According to a second variant of the system according to the first aspect of the invention, the alternate supply of the cavity by various heat transfer liquids will be carried out by means of valves arranged in the different pipes.

At least one valve will then be typically disposed, but not necessarily, in each heat transfer liquid supply channel downstream of each junction, but upstream of the junction between the different liquid supply channels when these meet before reaching the cavity. This valve can optionally be a 3/2 valve located at the junction and allowing, for each supply channel, to direct the liquid either to the bypass channel or to the cavity.

The system can also preferably comprise several sources of heat transfer liquids whose respective temperatures are controlled independently by means for controlling the temperature of the heat transfer liquid. The heat transfer liquid sources further comprise a means (pressure, pump, etc.) for circulating the liquid, which can be arranged upstream or downstream of the temperature control means.

The system can also include transfer pipes for transporting the heat transfer liquid from a heat transfer liquid source to the injection inlets of the chip.

The temperature control means for the heat transfer liquid can comprise a temperature-controlled liquid bath or an online temperature controller using both a Joule effect heating system or a thermoelectric device for changing the temperature of the circulating liquid as well as a temperature sensor for precisely controlling the temperature in a closed loop by means of a controller (for example of the PID type).

Preferably, the liquid circulation means are arranged upstream of the chip so as to avoid a parasitic heat transfer between the circulation means and the heat transfer liquid, which could change unpredictably the liquid temperature before entering the exchange zone. These circulation means can be common to all the liquid heat transfer sources. They can be formed by a pressure source for pressing the heat transfer liquid in a tank or a pump, which advantageously allows the liquid recirculation.

The system further preferably comprise means for switching the path taken by the heat transfer liquid so that each heat transfer liquid passes either though the exchange zone, or through the bypass channel.

According to the first aspect, the invention finally also relates to a method for carrying out a PCR type reaction in which a chip and/or a system as described above is preferably used.

According to the second aspect of the invention, the PCR reaction is generally carried out in a disposable container because at the end of the reaction the large-scale amplification of the DNA target to be detected contaminates the surface of the container with the target to be amplified, which prevents it from being reused. The containers of the PCR reactions are therefore so-called consumable containers.

An important issue in rapid cycling technologies is the design of a consumable container that receives the PCR reagent for a good temperature transmission to the sample so that the sample temperature equilibrates rapidly with the temperature of the thermal cycling device.

A specific implementation of the PCR is the real-time PCR in which the DNA amplification is measured during the reaction by a fluorescence signal from a probe whose fluorescence depends on the progress of the amplification reaction. In this case, an important issue of rapid cycling technologies is the design of a consumable container that receives the PCR reagent for a good thermal transmission to the sample so that the sample temperature equilibrates rapidly with the temperature of the thermal cycler.

In thermal cyclers of standard PCR, the PCR reagent is stored in standard micro-centrifugal tubes or in multi-well plates, which are provided for this purpose and which comprise receptacles for the reagent having comprising a conical bottom for collecting the liquid bottom of the tube when centrifuged. This consumable container is introduced in a thermalization block (temperature cycler) whose geometry is adapted to that of the consumable container. In the particular case of real-time PCRs, the consumable container must make it possible to measure the fluorescence of the reagent.

When the consumable container is a multi-well plastic plate or tube, the temperature is transmitted through the plastic wall separating the sample from the thermalization block. Since plastics are bad heat conductors, the thermalization speed of the sample is then limited. Moreover, the compact form of the PCR volume at the bottom of the tube is not adapted to a rapid change in temperature because the ratio between the smallest dimensions of the sample through which the heat must be transmitted and the volume of the sample is high, so very unfavorable. Indeed, it sometimes takes several tens of seconds to achieve thermal equilibrium through the thickness of the sample. On the other hand, the presence of air above the aqueous reagent causes evaporation thereof when heated, resulting in a cooling of the sample and a change in reagent concentration which is detrimental to the reaction.

These packaging methods have their speed limits in high performance devices such the eco48 model of the company PCRMax, which allows temperature change speed of the block of 5.5° C./s but does not allow a complete change in temperature if the sample in less than 10 s.

U.S. Pat. No. 5,958,349A discloses a thin plastic reaction chamber having thin plastic walls in contact on either side with thermalizing elements. In this configuration, the thickness of the sample to be thermalized is low and therefore particularly suitable for rapid changes in temperature. Furthermore, the flat and elongated configuration of the tube limits the contact surface between the sample and the air, including the evaporation of the sample. But the thermal conductivity of plastic walls does not allow a rapid change in temperature of less than 10 s.

On the whole, the speed of PCR systems is limited by 2 aspects: firstly the temperature change speed of the thermoelectric elements allowing with difficulty a change in temperature in less than 10 s and secondly, the low thermal conductivity of the consumable containers in plastic material which prevents the temperature from being rapidly transferred (<10 s) to the sample.

To overcome these drawbacks, EP 2787067A1 discloses a sample holder formed by a thin aluminum sheet in which cavities for receiving samples are stamped. These sample holders are directly in contact with a thermalization liquid whose temperature is modified by using valves, which allows a much faster change in temperature than those obtained with the thermoelectric elements. This system allows changes in temperature in less than 3 s, but the configuration used, in which the sample holder is in direct contact with the thermalization liquid, can be used with difficulty because it can be in particular a source of leaks of thermalization liquid into the environment. In addition, the open configuration of the sample holder does not limit the evaporation of the liquid.

In their publication "Under-Three Minute PCR: Probing the Limits of Fast Amplification," Wheeler et al. (Analyst, 2011, 136, pp. 3707-3712) uses a sample support formed by a copper block comprising a porous metal medium, through which two heat transfer liquids at two different temperatures are alternately circulated to allow very rapid changes in temperature of the block. In this system, the sample is here placed in a well of 54, made of a thin polypropylene sheet, which is inserted into the copper block and covered by a heating sheet made of substituted or unsubstituted polyimide, such as those sold under the trade name "KAPTON", which both enables to limit evaporation and maintain the temperature of the upper side of the sample. This configuration has the advantage of having an adapted format because the sample is not in contact with the thermalization liquid, but has the disadvantage of using an interface made of a thin plastic film, which is fragile and little suitable for a routine use by untrained personnel. Moreover, the heating polyimide sheet must be electrically powered to be used as a heating element, which complicates the consumable container and increases its cost of production.

Specific examples of PCR reactions are the so-called digital PCR in which the amplification of each individual target DNA strand is carried out in a separate volume of small sizes in order to be identified separately. The amount of target is then measured by the number of distinct volumes having a positive reaction. It may be droplet PCR or ddPCR (droplet digital PCR) as performed on the platform Naica marketed by the company Stilla Technologies, or PCR carried out in micro-wells or micro-chambers as performed on the platform EP1 marketed by the company Fluidigm. Advantageously, this type of PCR can also be performed in real time, which makes it possible to discriminate parasitic amplifications or the presence of more than one target in the reaction volume. To implement such a detection, it is necessary that the fluorescence measurement has a good spatial resolution for detecting a large number of targets (i.e., a large number of droplets or a large number of chambers) and thus obtaining a high reaction dynamics, that is to say, for enumerating both a small number and a large number of target DNA.

Zongh et al. report the challenges of the digital PCR in the journal "Multiplex digital PCR: breaking the one target per color barrier of quantitative PCR" (Lab on Chip, No. 11, pp. 2167-74 (2011)).

All these systems enable to obtain rapid temperature change speeds or a spatially resolved observation, but suffer from certain limitations, which do not allow a rapid and precise temperature control while allowing an optical measurement of the spatially resolved sample.

Also, the PCR consumable containers of the prior art do not allow a rapid (<5 s), accurate, consistent and reproducible temperature control while allowing a measurement of the fluorescence of the sample with a spatial resolution and/or a heat exchange interface between the sample and the thermalization film which can be implemented in a simple manner.

Yet the current needs of rapid tests for diagnosis orientation or in emergency contexts require reactions such as PCR in few minutes.

According to the second aspect of the invention, the inventors have noticed that the observation with a spatial resolution has several advantages: for one hand, in a PCR in a homogeneous solution, it allows to control the homogeneity of the reaction and on the other hand it allows to use a consumable container containing several chambers for carrying out several reactions in parallel under the same temperature conditions in order to test multiple targets or multiple samples in parallel, it finally allows digital PCRs with the advantage of allowing a more precise quantification, obtaining lower sensitive thresholds and a less quantification sensitivity for the PCR inhibitors and PCR performance, the real-time measurement of the reaction also allowing a better discrimination of the parasitic amplifications.

Moreover, one of the goals of the inventors is to design inexpensive tests. For this purpose, the consumable container must be simple to manufacture, which is a key issue for marketing this type of test.

A PCR requires 30 to 40 temperature cycles whose minimum duration is about 8 s, each second gained over the temperature change time thus reduces the reaction time from 60 to 80 s.

Moreover, the complexity of PCR-based molecular detection kits, especially for multiplex detection, requires that the temperatures at the different phases of the cycle be controlled very precisely in order to operate correctly.

In addition, the large reaction volume (about 20 μL) generally required for these tests is adapted to a heat transfer liquid thermalization system because the instantaneous power required to heat the sample during the change in temperature is so important that it is generally incompatible with the use of other technologies.

Finally, a rapid, accurate, consistent and reproducible temperature control is interesting for analyzing many other chemical, biochemical and physiological reactions involving temperature, either in an artificial reagent or within a natural, living or not, solid, liquid or gaseous sample.

A sample temperature control system based on heat transfer liquid exchange that is fast (<5 s), accurate, homogeneous, reproducible, in combination with a fluorescence measurement having a spatial resolution, is therefore of great interest in many fields.

The invention according to its second aspect makes it possible to re solve the various above-mentioned problems.

According to the second aspect, the invention relates to a micro-fluidic sample chip for testing biological samples, in particular for PCR and/or fluorescence analysis, in the form of a hollow block comprising at least one chamber delimited by an upper wall, a lower wall and at least one side wall, into which a sample to be tested can be introduced, characterized in that the block is provided with at least a first side and a second side parallel to each other, the first side (or lower side) being disposed under the lower wall made of a material having a high thermal conductivity, preferably greater than 1 $W \cdot m^{-1} \cdot K^{-1}$, the second side (or upper side) being disposed on the upper wall made of a material having a low thermal conductivity and moreover being permeable at least in one of the chambers, to radiations having a wavelength between 300 nm and 900 nm, preferably permeable to radiations in the visible spectrum between 400 and 700 nm, this block comprising at least two openings for introducing the sample into at least one of the chambers and discharging the atmosphere in the chamber during the introduction of the sample.

Preferably the sample chip is characterized in that at least one opening is disposed on the second side and passes through the upper wall into at least one of the chambers.

According to a variant, the chip is characterized in that at least one opening is disposed on at least one side wall and passes therethrough into at least one of the chambers.

According to a variant, the chip is characterized in that at least one opening is in communication with a micro-fluidic circuit integrated in another part of the sample chip and comprising means for pre-treating the sample (e.g., filtering or retaining in a manner known per se certain elements of the sample before the PCR treatment), post-treating the sample (adding an additive or other after the PCR treatment) or any other operations which may be necessary or helpful.

Preferably, the block has an outer shape of a parallelepiped or a cylinder, whose sides of the upper and lower walls are parallel to each other.

More preferably, the openings are sealed after introduction of the sample into at least one chamber, the different walls of the chip being put together so as to withstand without damage an internal and/or external pressure greater than or equal to 500 mbar, preferably greater than or equal to 1 bar.

According to one embodiment, the chip according to this second aspect of the invention is characterized in that its lower wall is made of a material having a thermal conductivity greater than or equal to 15 w·m-1·K-1, preferably greater than or equal to 100 w·m-1·K-1 and, on the other hand, which is preferably not a PCR-type reaction inhibitor such as, in particular, pure aluminum and/or its mixtures or derivatives and more particularly 6010 aluminum (defined by the International Designation System for Alloys), with or without an anti-corrosion treatment such as anodizing treatment.

According to yet another variant, the chip is characterized in that the thermal conductivity of its upper wall is less than or equal to 1 w·m-1·K-1, and in that its effusivity is preferably less than or equal to 1000 J·m-2·K-1·s–0.5 and preferably tolerating a temperature greater than or equal to 95° C. without deforming (i.e., a deflection temperature under load (ISO 75), and glass transition temperature of the material >95° C.).

Preferably, an upper wall of the chip is made of a transparent plastic material selected from polycarbonates and their derivatives and/or the polymers or cyclic olefin copolymers (commonly referred to as COCs and COPs) and derivatives thereof.

According to a preferred configuration, the chip comprises from one to four parallelepiped-shaped chambers, each of which is preferably connected to at least two openings.

According to the second aspect, the invention also relates to a PCR-type system for analyzing a sample contained in a chamber in a sample chip as described in the present application, comprising especially:

thermalization film for increasing or decreasing, by thermal cycling, the temperature of the chip and the samples therein, in thermal contact with the lower side of the sample chip, which is characterized in that it further comprises:

means for closing the openings in the chambers used in the sample chip for maintaining a relative internal pressure of at least 5000 Pascal (50 mbar), preferably at least 50000 Pa (500 mbar), in said chambers, the increase in temperature of the sample causing the chambers to expand, improving thereby the thermal contact between the lower side and the thermalization film, means for maintaining an outer pressure greater than 50 mbar over the entire upper side of the sample chip in order to provide substantially uniform thermal contact between the lower side of the chip and the thermalization film, the transparent portion of the upper wall of the chip traversed by light rays being located above at least one of the chambers containing one of the samples.

The system according to this second aspect of the invention preferably comprises optical measurement means, preferably for an optical observation of the samples with a spatial resolution.

According to a first variant, the system comprises a heat-conducting part, preferably a metal part having a thickness less than or equal to 1 mm, between the lower side of the sample chip and the thermalization film, preferably an aluminum metal film.

According to another variant, the system comprises rapid thermalization film capable of generating a change in temperature of the sample greater than or equal to 5° C./s.

Preferably, the system comprises means for maintaining a relative external pressure greater than 1 bar on at least one part, preferably all the upper side of the sample chip.

According to a preferred embodiment, the system comprises external pressurizing means formed by a plate of transparent material, preferably glass, associated with a frame disposed at the periphery of the plate and elastic means such as springs applying a pressure onto said frame.

According to a variant, the system comprises external pressurizing means formed by a housing with external dimensions identical to those of the chip for introducing this chip into the housing at a ambient temperature, the walls of the housing exerting a pressure onto the upper and lower walls of the chip during a temperature rise of a sample trapped in at least one chamber of said chip, due to the expansion of the chambers.

According to another variant, the system comprises means for injecting a sample into at least one of the chambers when this chip is already positioned in the system.

According to yet another variant, the system also comprises means for sealing the openings of the chip after filling at least one of the chambers.

The invention also relates to an device, a system and a method implementing the first and second aspects of the invention, that is to say comprising both a thermal cycling system and a thermalization chip according to the first aspect of the invention, in combination with a sample chip whose dimensions are adapted to those of the supplementary housing in which the sample chip is inserted, which contains at least one transparent upper wall of the second aspect of the invention, as well as preferably an optical system for measuring the fluorescence of the sample, the thermal cycling alternately carried out at different temperatures making it possible to multiply the DNA in the sample of the sample chip maintained under pressure throughout the thermal cycling.

Throughout the description, the following terms will also have the following meaning:

- thermalization of a sample (or "thermalize" in general) means modifying the temperature so that the sample temperature reaches a desired temperature.
- temperature change speed for a sample from a temperature T1 to a temperature T2 different from T1 means the time required for the sample to change from the temperature T1 to an effective temperature T2eff such that (T2−T2eff)/(T2−T1)<5%.
- a change in temperature is said reproducible if the temperature change profiles over time for two successive changes in temperature can be superposed whatever the previous conditions of change in temperature be (superposition of temperature difference on the temperature axis with a precision of about 5% or superimposition of the temperature change speed on the time axis with a precision of 5%).
- homogenization tree means a micro-fluidic network, typically formed by a series of divisions of a channel, for homogenizing the flow rate along the major axis of the section of a large chamber with respect to the size a liquid inlet (or outlet) into this chamber. This designation "homogenization tree" will be used in the present description and the claims to designate in general any means for homogenizing the pressure at the inlet and/or outlet of the thermalization zone, in particular the pressure homogenization zones formed by parallelepiped-shaped volumes or any other similar form respectively juxtaposed at the inlet and the outlet of the thermalization zone 202 so that these volumes increase the thickness of the thermalization zone at the inlet and outlet thereof, the lower resistance to the flow of the liquid in these volumes in comparison with the resistance to the flow in the thermalization zone homogenizing the pressure over the width of the thermalization zone. These parallelepiped-shaped or similar volumes having a width equal to the width of the thermalization zone 202 so as to homogenize the pressure over the entire width, a thickness between 2 and 6 times the thickness of the channel(s) of the thermalization zone, and a length between 2 and 6 times the thickness of the thermalization channel(s) give them a lower resistance to the flow.

It is important to note that the homogenization zone or homogenization tree is part of the length L (in other words, the heat exchange or thermalization zone of surface S does not include the possible homogenization zones).

The term "cavity" designates a cavity having generally a parallelepiped shape (although it is always possible without departing from the scope of the invention to give it a cylindrical, frustoconical, etc. . . . shape, the shape (horizontal section) of the cavity being essentially dependent on the shape of the plate (or chip) used to deposit the sample to be subjected to thermal cycling or other).

Since the plate with optical sensors has usually a rectangular shape, the chamber(s) containing the sample are advantageously rectangular, so that the horizontal section of the cavity will generally have the same dimensions as the rectangular plate used, the term substantially indicating that these dimensions can vary (mainly for practical reasons) by more or less 10% compared to the dimensions of the plate to be used with the cavity in which it is housed. As a general rule, the sample holder plates used have dimensions of about 14 mm×14 mm for example containing a chamber of 10 mm×10 mm.

The term "bypass channel" designates a channel making it possible to divert at least a portion of the heat transfer liquid from an injection channel and to prevent it from passing through the cavity while ensuring a continuous circulation of heat transfer liquid in the injection pipe upstream of the junction of these two channels.

The term "digital PCR" is defined and described in the article "The digital MIQE guidelines: minimum information for publication of quantitative digital PCR experiments" of J. F. Hugget et al.—Clinical Chemistry 2013" as well as in U.S. Pat. No. 6,143,496 of Brown et al.

BRIEF DESCRIPTION OF THE DRAWINGS

The invention will be better understood with the aid of the following exemplary embodiments illustrating the first and second aspects of the invention, given in a non-limiting manner together with the figures in which.

In all the figures, the same elements have the same references.

DETAILED DESCRIPTION OF THE EMBODIMENTS

Figure 1:
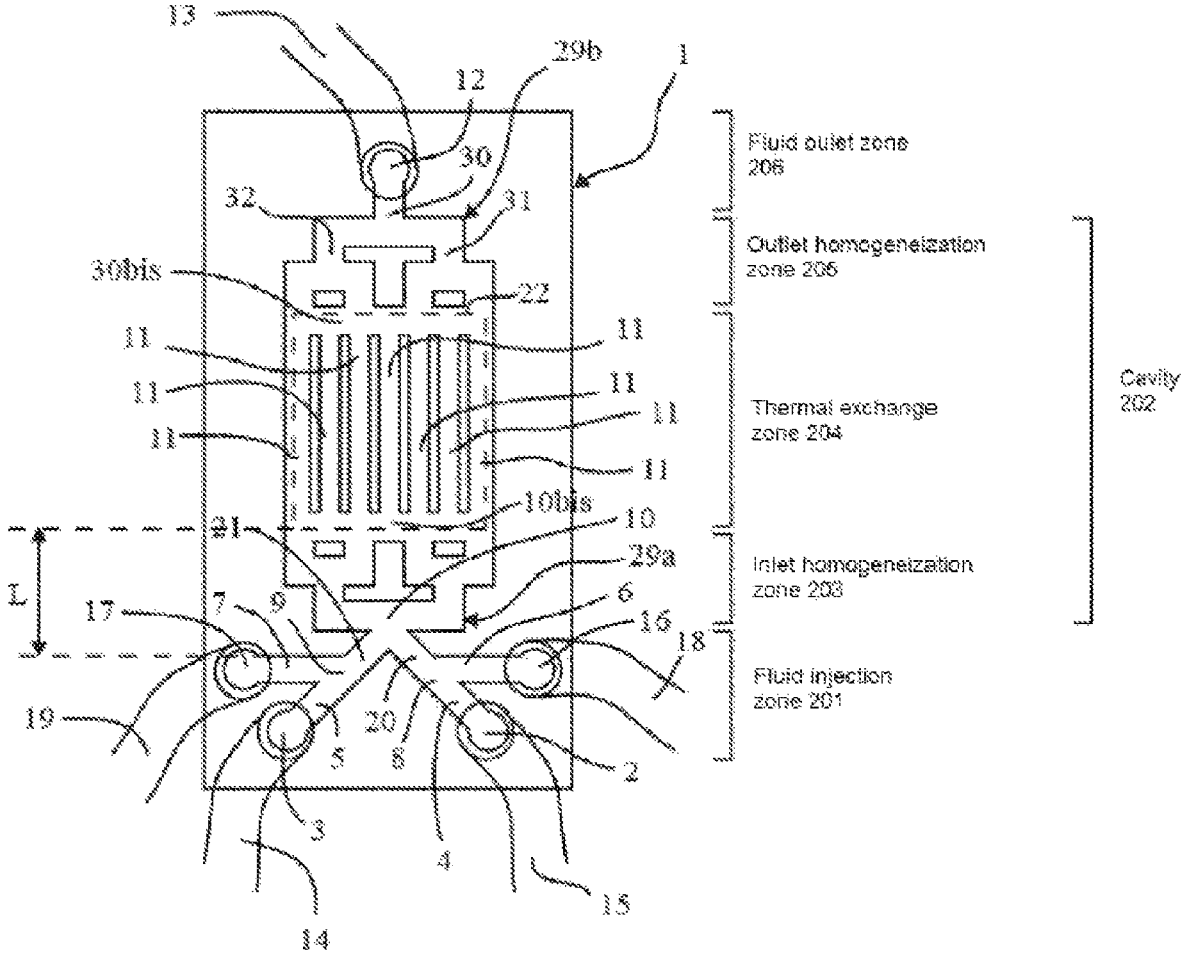
FIG. 1 shows an exemplary embodiment of a micro-fluidic chip according to the invention.

FIG. 1 schematically shows a micro-fluidic 1 chip exchanging heat between the heat transfer liquids when they are injected into the chip and the sample (DNA for example), not shown in this figure, in contact with the chip. The chip 1 is formed by a block of parallelepiped-shaped material having an upper side, comprising a heat exchange zone 204 provided with a thermalization zone (heat exchange) 22 with a surface S (surrounded by a dotted line in the Figures) towards which the heat transfer liquid injection channels 4, 5 converge.

The fluid injection zone 201 comprises a pipe 15 with a first heat transfer liquid, connected to the chip 1 via a first connection port 2, while a second pipe 14 is connected to the chip 1 by via a second connection port 3. The input ports 2 and 3 are respectively connected to the supply channels 4 and 5 respectively extending up to the junctions 8 and 9, to which the bypass channels 6 and 7 are also respectively connected, which respectively extend to the output ports 16 and 17 for discharging the heat transfer liquid into the bypass pipes 18 and 19 respectively. (The supply channels can be the bypass channels and vice versa).

Each junction 8, 9 extends by means a supply channel portion 20, 21 respectively, which meet at their other ends at the inlet 10 of the cavity 202 for introducing the heat transfer liquid into the inlet homogenization zone 203 which comprises a homogenization tree for the liquid 29*a* (in order to give it a good flow rate homogeneity at the inlet of the thermalization zone 22). The heat exchange zone 204 comprises the thermalization zone 22 itself, preferably formed by a plurality of parallel channels 11, preferably uniformly distributed over substantially the entire width of the chip, in the zone 22 for contacting the sample to be analyzed. At the other end of these channels 11, the heat transfer liquid is collected at the outlet 30*bis* of the thermalization zone 22 (which is part of the heat exchange zone 204) and then, after passing through the outlet homogenization zone 205 comprising a homogenizing tree 29*b* preferably similar to that 29*a* disposed in the inlet homogenization zone 203, is collected at the fluid outlet zone 206 via the outlet 30 of the cavity 202 connected to the connection port 12 of the chip 1 in the outlet pipe 13 (the pipes 13, 14, 15, 18 and 19 are not part of the chip 1 in this example).

According to an alternative embodiment, an independent output is provided for liquids at different temperatures, for example by means of one or more valves after the connection port 12 for orienting the liquid into different tanks in order to limit the mixing of liquids of different temperatures). Each injection channel 4, 5 comprises a junction 8, 9 towards an outlet 16, 17 for additional liquid for circulating the heat transfer liquid continuously in the pipe 18, 19 upstream of the chip 1 and thereby stabilizing the temperature of the liquid in order to avoid to perturbation due to change in temperature of the heat-transfer liquid.

The distance L between the junctions 8 and 9 and the thermalization zone 22 depends on the thermal characteristics of the chip and must be as follows:

$$L<S/a$$

S being the surface of the upper side of the cavity (202) in m2, a being a correction coefficient equal to 0.005 m.

In this way, the transient effect of the materials surrounding the thermalizing liquid upstream of the thermalization zone is not sufficient to prevent a reproducible change in temperature as previously defined.

Thus, for a heat transfer fluid flow rate of about 10 ml/min (1.6e-7 $m^3/s$), this distance L between the junctions 20 and 21 and the fluid inlet 10*bis* of the thermalization zone 22 will preferably be less than 2 cm.

Figure 2A:
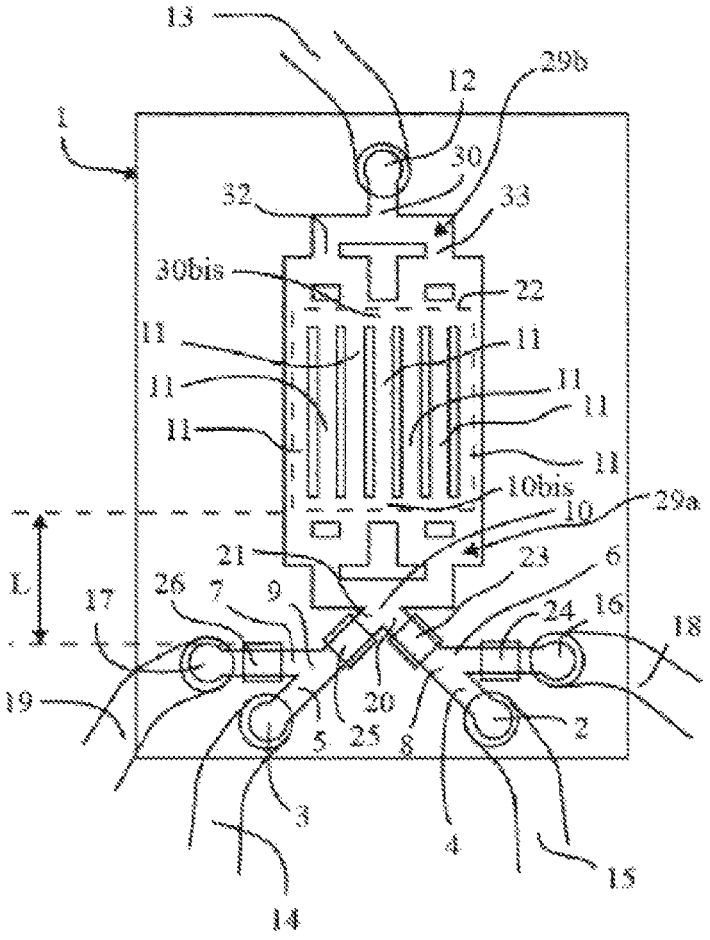
FIGS. 2*a*, 2*b* and 2*c* show an alternative embodiment of the chip in FIG. 1, in which fluid switching valves are integrated.

FIG. 2A represents an alternative embodiment of the chip in FIG. 1, in which liquid switching valves 23, 24, 25 and 26 are integrated for allowing each liquid from the pipes 14 and 15 to pass either into the channels 11 or in the bypass channel 6, 7 provided for this purpose.

Thus, when closing the switching valve 23 and simultaneously opening the valve 24, the liquid from the pipe 15 is then sent into the bypass pipe 18. Simultaneously (if desired) the liquid from the pipe 14, if the valve 25 is opened and the valve 26 is closed, will enter the chip and, after homogenization, the channels 11 to carry out the thermalization of the DNA sample which will contact the chip.

Figure 2B:
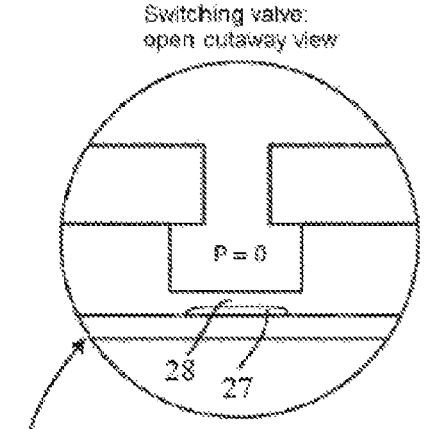
Figure 2C:
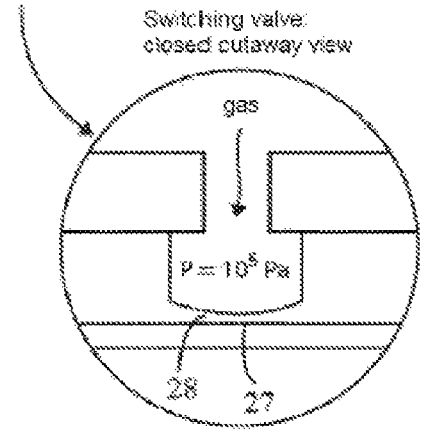

FIGS. 2B and 2C respectively represent an enlarged detail of an exemplary embodiment of a pneumatically-controlled valve integrated to the chip in an open position (FIG. 2B) and a closed position (FIG. 2C) under the action of a control signal.

In a manner known per se (Unger et al., Science 288: 7, 113, 2000), each valve is formed for example by a membrane 28 which is open in the rest position (P=0, FIG. 2B) and which is closed when it is activated by injection of a pressurized control gas (FIG. 2C) which causes this membrane 28 to stick onto the opposite portion 27 of the pipe on which it is fixed.

Figure 3A:
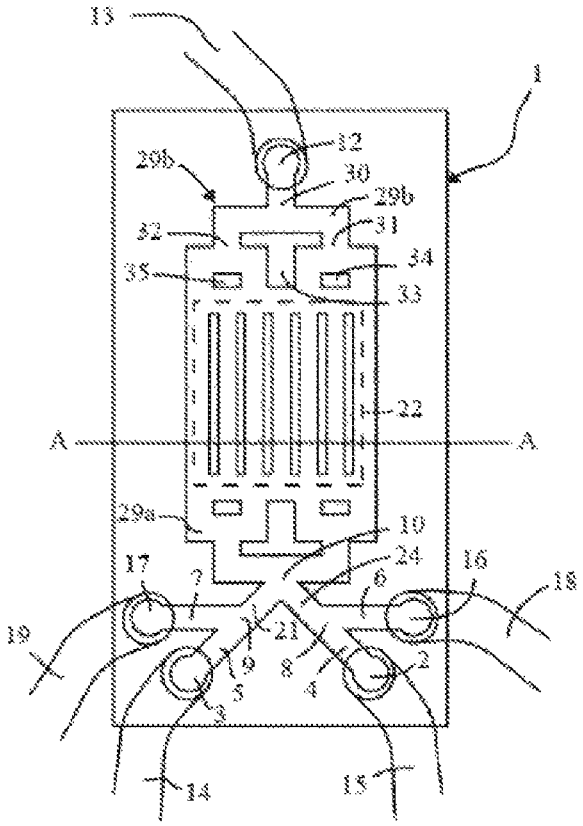
FIG. 3 shows, in FIGS. 3*a*, 3*b*, 3*c*, other variants of the chip associated with a sample holder containing a sample to be analyzed, according to the system of the invention.

FIG. 3A represents a top view of the chip in FIG. 1, on which a few additional embodiment details are represented notably at homogenization trees 29*a* and *b*. Each tree comprises a first junction close to the inlet 10 or outlet 30 dividing the fluid inlet of output channel into two side channels 31 and 32 which divide a second time at the junctions 34 and 35, allowing thereby the homogenization of the liquid flow rate along the large section of the inlet 10*bis* and the outlet 30*bis* of the thermalization zone 22. This homogenization is due to the fact that each end of the junctions of the trees formed by the side channel is equidistant between the liquid inlet of outlet, giving thereby a equivalent flow resistance to these different paths.

Figure 3B:
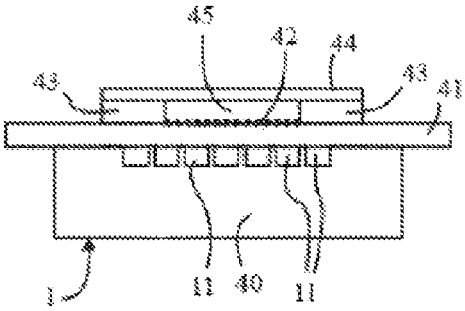
Figure 3C:
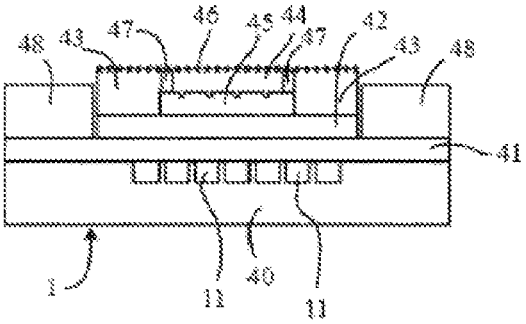

FIGS. 3*b* and 3*c* show sectional views along A-A of the chip 1 surmounted by a sample holder (not shown in FIG. 3*a*).

In the first variant in FIG. 3*b*, the chip 1 is represented in a parallelepiped-shaped block 40 of polymeric material (here 5 mm high) such as polydimethylsiloxane (PDMS) in the upper part of which there is a plurality (seven in the figure) of parallel channels 11 (of rectangular section) opening onto the surface of the chip 1, with a depth of 100 microns in this embodiment, these channels having a width preferably between 1 and 2 mm, each channel 11 being separated from the neighboring channel by a distance preferably lower than the distance from the surface of the chip to the sample (i.e. about 170 microns in this example, corresponding to the thickness of the glass slide 41). The glass slide 41 (or any other material allowing a good heat transfer between the heat transfer liquid circulating in the channels 11 in use) supporting the sample is applied to the channels 11 in order to close them preferably in a watertight manner, while the upper side of this slide 41 is locally treated by using a polyethylene glycol (PEG) based treatment to prevent the adsorption of the DNA on the glass surface, for example more particularly with the aid of a polylysine-polyethylene glycol copolymer which has a good adsorption capacity on glass. All around the thus treated zone 42 extends a silicone crown forming a sample holder 43, which is closed, after introduction of the sample, by a film 44, for example of plastic (here a polypropylene film 100 microns thick). In this version, the chip and sample holder assembly is preferably sealed, the assembly being discarded after use.

It should be noted that, in all the embodiments according to the invention, the film or the wall 44 (generally transparent) and the side wall 43 delimiting the cavity 45 may be formed by a single piece, according to a variant of the invention, for example molded, of transparent plastic material.

In the second variant of FIG. 3*c*, the channels 11 are closed by means of an aluminum sheet 41 of 300 microns in thickness, on which is applied the sample holder formed by a clamping piece 48 in the form of a crown to maintain the film 41 on the channels in a sealed manner, at the bottom of which is placed an aluminum film 42 (in this example identical to the film 41) supporting a sample holder piece 43 made of polycarbonate provided with a cavity having a height of 200 microns, whose bottom is formed by the film 42 and filling ports 47 which are closed by a polyester/silicone adhesive film 46 in this example. The set 42, 43, 46, after filling and testing the sample, can be discarded, the rest can be reused.

The separation films 41 and 42 between the heat transfer liquid and the sample are generally carried out from a heat conducting material whose thermal conductivity/thickness ratio (lambda/e) is higher than 1000 $Wm^{-2}K^{-1}$ and whose thermal diffusivity/squared thickness ratio ($D/e^2$) is greater than 2 $s^{-1}$ [For example, a glass slide of 500 microns meets these criteria, which corresponds to the reasonable limit in terms of conductivity and diffusivity to obtain a change in temperature in a few seconds].

The heat transfer liquid flow rate per unit area to be thermalized (surface of the exchange zone) required for the thermalization of the sample will preferably be less than 30 $mL \cdot min^{-1} \cdot cm^{-2}$.

FIG. 4 describes two variants of use of the chip and its system described in FIGS. 1 to 3, to carry out the thermal "cycling" required in a PCR-type analysis by means of heat transfer liquids of different temperatures successively circulated in the channels 11 of the chip, in thermal contact with the sample. For this purpose, the system in FIG. 4 comprises means for switching the path followed by the heat transfer liquid so that, for each heat transfer liquid, it passes either through the channels 11 of the thermalization zone 22, or by a bypass channel. Several configurations are possible to perform this switching process.

Figure 4A:
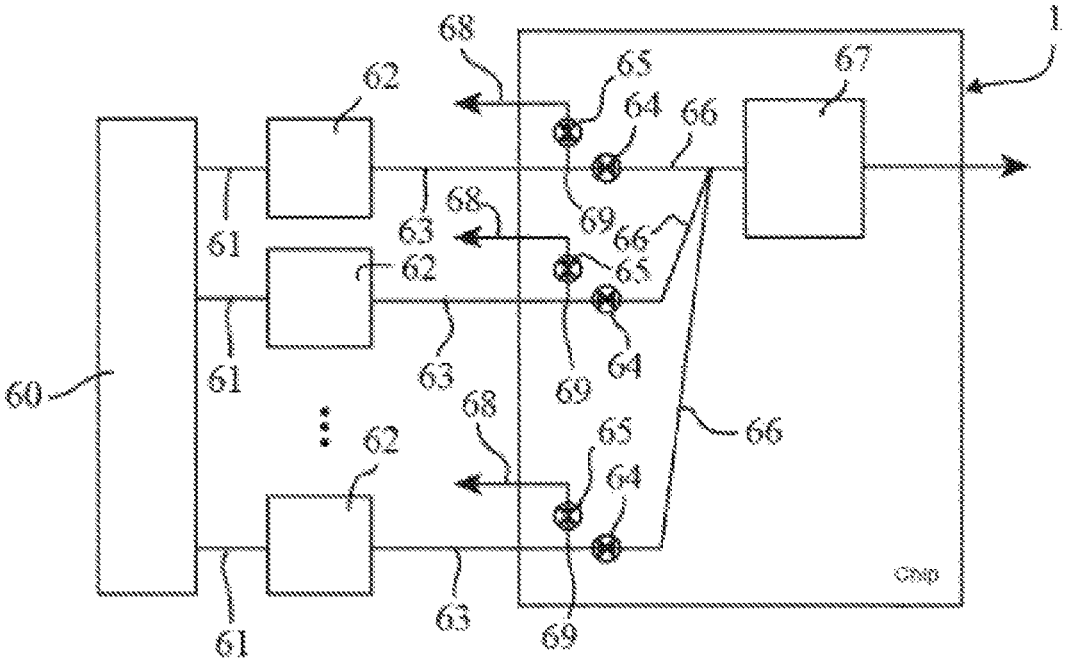
FIGS. 4*a* and 4*b* show two variants of the system according to the invention in which the various heat transfer liquids alternately circulate through a valve assembly (FIG. 4*a*) or due to pressure variations to liquids (FIG. 4*b*)

For example, according to the variant in FIG. 4*a*, pneumatic switching valves are used, for example integrated in the chip (as shown in FIG. 3), arranged upstream of the thermalization zone 22 with the sample and on the two circulation junction, for directing the liquid leaving the heat transfer liquid source 60, flowing in the channel 61, the thermalization film 62 for the heat transfer liquid (to bring the liquid to a good temperature), the channel 63, either to the exchange zone 67 through the open valve 64 (and the closed valve 65) and the channel 66, i.e. to the bypass channel 68, through the open valve 65 (and the closed valve 64 connected to the junction 69 at the valve 65). When a valve 64 is open allowing the heat transfer liquid of the branch to circulate, all the other valves 64 are closed (except exceptions) while the valve 65 (of the branch whose valve 64 is open) is closed, all the others valves 65 being open to allow the bypass of the chip 1. These pneumatic valves will close the micro-fluidic channels concerned with a gas under pressure applied on a deformable membrane positioned above the channel (see FIGS. 2B and 2C) as it is commonly used in micro-fluidic chips made of elastomer such as PDMS.

Figure 4B:
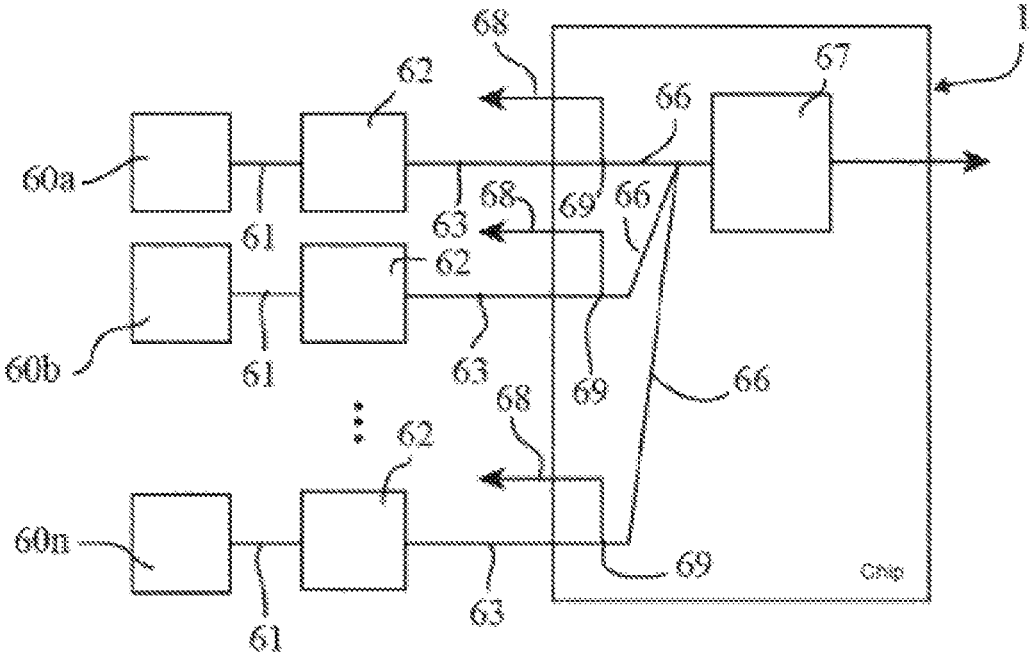

According to the variant in FIG. 4*b*, independent and variable-pressure heat transfer liquid sources are used. For this purpose, the pressure of heat transfer liquid transferred to the exchange zone 22 must be higher than the pressure of the other heat transfer liquids. The pressure of the other sources must be dimensioned, in a manner known per se, as a function of the flow resistance of the different branches of the circuit so that this pressure is sufficiently low to avoid any transfer of liquid from these sources into the exchange zone. This solution however requires a fine adjustment of the pressures of the different heat transfer liquids to obtain a proper operation.

Advantageously, whatever the variant used, the heat transfer liquid can be re-circulated for example independently for each source by means of pumps. This makes it possible to limit the energy consumption necessary for controlling the temperature of each source by reusing the previously thermalized heat transfer liquid. For this purpose, it is possible, for example, to use a piston or gear positive displacement pump which makes it possible to ensure a constant heat transfer liquid flow rate for each source, which makes it easier to control the temperature accurately (for example, ceramic pumps which can tolerate high temperatures). Generally speaking, all the materials and equipment used in the context of the present invention cab generally withstand (and operate at) temperatures of at least 100° Celsius when it is desired to perform PCR-type analyzes.

To do this, each circulation junction is redirected preferably to the original heat transfer fluid source and the outlet of the exchange zone can be distributed to all the sources. The outlet of the chip can also be redirected to its original source, but in this case it is necessary to add a valve to redirect the liquid to the tank. (See FIG. 6).

A tank can also be inserted into the circuit upstream of the pump to ensure good filling of the circuit with the heat transfer liquid. In some configurations, the flow rates cannot be balanced in the different channels of the circuit and some tanks can be filled faster than others. It may then be advantageous to connect the tanks to each other by the pipe 121 (FIG. 6) so that their levels equilibrate, which also has the advantage of filling all the tanks from a single opening. Advantageously, these tanks can have a volume lower than 20 ml, allowing a small space requirement, a reduced thermal capacity and low thermal losses.

Two embodiments of the invention will now be described with reference to FIGS. 5 and 6:

Example 1

Figure 5:
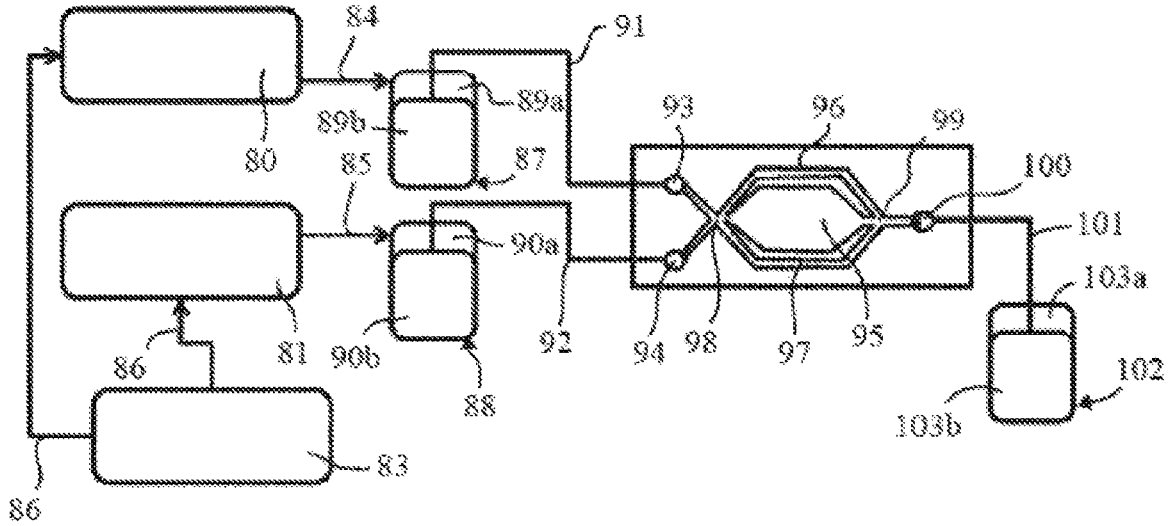
FIG. 5 shows another variant of the system according to the invention in which all the liquids in the bypass channels are recovered in the same container, FIG. 6 show another variant with a thermalization system for heat transfer liquids by means of pumps.

In FIG. 5, a first pressurized gas generator 80 generates a compressed gas (air and/or inert gas such as nitrogen and/or argon) which flows via the line 84 into the gas sky 89*a* of the tank 87 of a first heat transfer liquid 89*b*. A second pressurized gas generator 81 generates a compressed gas (preferably the same as the first generator) which flows via the line 85 in the gas sky 90*a* of the tank 88 of a second heat transfer liquid 90*b*. The two liquid 89*b* and 90*b* are respectively injected by the pressure exerted by the respective gaseous skies, respectively in the pipes 91 and 92 up to the respective inlet ports 93 and 94 of the chip 1, of the type described in FIGS. 1 to 3. The liquid flows meet at the junction 98 substantially located at the inlet of the exchange zone 95 in which one or the other heat transfer liquid alternately circulates. When the pressure of one liquid is greater than that of the other (at least 40%, preferably at least 42% but less than 55% so as not to create a reflux of the liquid into the other way. These minimum and maximum values depend on the geometry of the chip and the temperature of the liquid to be injected. They are determined experimentally by thermal imaging or modeling so as to obtain the desired flows as described below), it is this liquid that will enter the exchange zone as well as the bypass channel associated therewith, while the other liquid continues to circulate in the bypass channel associated therewith (96 for the first liquid and 89*b*, 97 for the second liquid 90*b*). At the junction 99 to the output of the chip where the pipes 96 and 97 converge, the liquids are directed to the outlet port 100 and flow through the pipe 101 towards the recovery container 102 which contains a liquid mixture 103*b*. The alternation of the liquids in the exchange zone 95 and the temperature variation in this zone are controlled by the control system 83. The pipes 96 and 97 enable the liquids to circulate continuously. In this way, the distance between the junction 98 and the inlet of the chamber 95 can remain, according to the invention, lower than the value defined above for L. In the present example of the system according to the invention, the gas generators whose pressure is controlled by a computer (for example the systems of the company ELVESYS sold under the trade name "Elveflow OB1 mk3") are used as a means of circulation that pressurize the two tanks 87 and 88 controlled in temperature with a thermoelectric module. The pressures of the delivered gases are set according to two configurations so as to obtain a temperature control of the DNA sample (or other) at two different temperatures. In the first configuration, the pressure of the gas delivered by the second generator 81 is at least 1.5 times higher than the pressure of the gas delivered by the first generator 80 (determined experimentally by thermal imaging or modeling so as to obtain the desired flows as described below), so that the liquid 89*b* contained in the tank 87 at a first temperature circulates only in the bypass channel 96 while the liquid 90*b* contained in the tank 88 at a second temperature circulates in the bypass channel 97 and in the exchange zone 95. In this configuration, the sample is thus very quickly brought to the second temperature by indirect heat exchange with the second heat transfer fluid 90*b*. The precise ratio between the pressures of each generator depends on the precise geometry of the chip, the temperatures of the heat transfer liquids that affect their viscosity and the selected way so as to circulate in the exchange zone. The precise values of these pressures can be determined experimentally by thermal imaging of the heat conducting side of the chip which makes it possible to image the temperature of the circulating liquids respectively in the channels 4, 5, 95, 96 and 97 through the heat conducting layer. For this purpose, the pressure values of the generators must be adjusted for each liquid source (each temperature) that can circulate in the exchange zone (two, in this case). For each source of circulating liquid, the good pressure balance is achieved when the thermal imaging shows that the entire surface of the exchange zone 95 is at the desired temperature and the bypass way 96 or 97 is at the temperature of the liquid that must pass in this one. It is also possible to predict these pressures by a hydrodynamic modeling taking into account the geometrical parameters and dependence parameters of the viscosity of the heat transfer liquid temperature.

Conversely, in the second configuration, the pressure of the gas delivered by the first generator 80 is higher (under the same conditions as explained above) than the pressure of the gas delivered by the second generator 81 so that the liquid 90*b* contained in the tank 88 at a second temperature circulates only in the bypass channel 97 while the liquid 89*b* contained in the tank 87 at a first temperature circulates in the bypass channel 96 and in the exchange zone 95. In this configuration, the sample is very quickly brought to the first temperature by indirect heat exchange with the first heat transfer liquid 89*b*.

At any time, the heat transfer liquid circulate in the pipes, in particular 91, 92, 96, 97, so that the change in temperature in the heat exchange zone is rapid (less than 5 s), reproducible and the sample temperature can be precisely controlled, even when low heat transfer fluid flow rates are used, for example flow rates of less than or equal to 10 ml/min.

Such a system can be used to perform PCR reactions, but also observations on live biological samples. Advantageously, the use of a thermoelectric module makes it possible to control the temperature of the sample at temperatures below the room temperature. This possibility may be useful to study the physical, chemical or biological phenomena such as the polymerization dynamics for the microtubules within living cells, which requires the thermalization of the cells at temperatures below 5° C.

According to another alternative embodiment, the injection channels 63 can meet into one single channel before the junctions 69 (see FIG. 4), as it is the case in FIG. 5. As the transport of the liquid in the micro-fluidic chip is laminar (non-turbulent), the liquids in the single channel 63 do not mix and keep their respective temperatures up to the junction 69 or they can be separated again between the bypass channel 68 and the channel 66 guiding the liquid to the thermalization zone 67.

Generally, the height of the thermalization zone 22 will be inferior to one millimeter, preferably to 400 microns, which allows a high convection coefficient and a low time of renewal of the heat transfer liquid in the chip for low flow rates of injection into the chip.

Example 2

Figure 6:
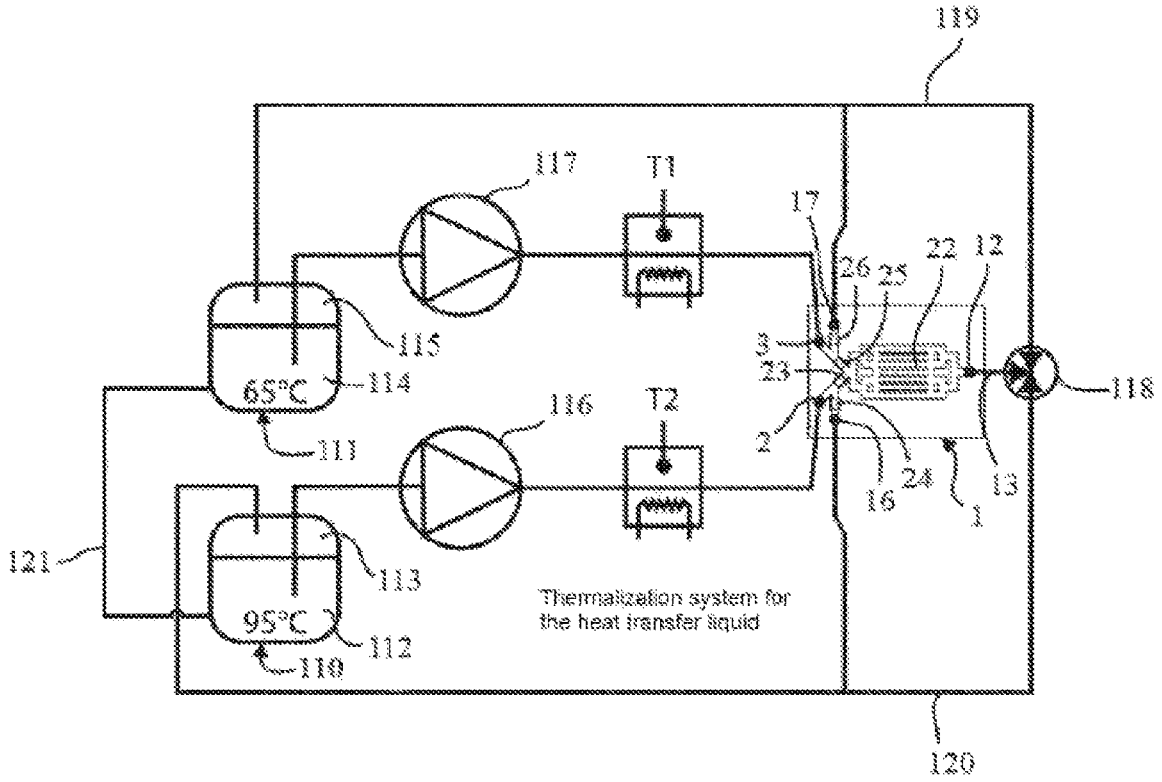

In this example corresponding to FIG. 6, the micro-fluidic chip 1 for temperature control comprises a substantially parallelepiped-shaped cavity whose upper side corresponding to the thermalization zone 22 has a surface S of 1 $cm^2$ and a height of 300 μm. It comprises five ports 2, 3, 16, 17, 12 (as in FIG. 1) and is used to switch two heat transfer liquids 112 and 114 at different temperatures between the thermal exchange zone 22 and two circulation junction by means of four integrated valves 23, 24, 25 and 26 as shown in FIGS. 1 to 3. It is made by molding PDMS and bonded on an aluminum sheet of 300 μm in thickness by means of a light-activatable adhesive (e.g., glue sold under the trade name "Loctite 3922") on which the sample holder is placed in thermal contact. The chip is supplied by two flow tanks 110 and 111 of respectively heat transfer liquids 112 and 114, each of them being connected to a positive displacement pump 116, 117 providing a flow rate of 10 ml/min, whatever the pressure in the circuit, and an online thermalization device for the heat transfer liquid comprising an aluminum body for a significant thermal exchange between this body and the liquid, a Joule effect heating ceramic element in contact with the body (such as those marketed by the company Thorlabs), a miniature temperature sensor (such as marketed by the company Radiospares under the name "PT100") and an electronic card for control temperature equipped with a system control PID for controlling the temperature of the body by means of the temperature sensor.

The two tanks 110 and 111 are arranged respectively upstream of the pumps 116, 117 so as to serve as a liquid supply. The tank levels can be adjusted relative to one another by a system of communicating vessels. In addition, a "3/2"-type valve 118 makes it possible to redirect the liquid leaving the chip via the pipe 13 to the tank 110 or 111 supplying the contents of the thermalization zone 22, under the control of a control system, non shown in the figure, controlled by a computer sequencing the different valves according to the liquid and the desired injection duration.

To carry out a PCR analysis with a system as described in FIG. 6, it is preferable to use a cartridge composed of a parallelepiped-shaped micro-fluidic chamber of 20 μl, having a surface of 1 $cm^2$ and a height of 200 microns, for example molded in a polycarbonate piece glued (at the micro-channel 11) on an aluminum sheet of 200 μm in thickness: this chamber is filled with the PCR reagent mixture and the sample to be analyzed (for more details concerning the procedure described, see the article of Houssin et al. cited above). This cartridge is pressed against the aluminum sheet of the thermalization chip to achieve a good thermal contact. It is also possible to carry out a Real-time PCR analysis in the same conditions as in the article of Houssin et al. by placing under the chip a chamber for receiving the reagent while measuring the fluorescence. The sample is first thermalized at 95° C. for 30 s by circulating the heat transfer liquid thermalized at 95° C. by the online temperature controller while the heat transfer liquid thermalized at 65° C. is redirected to the circulation junction. To do this, the valve 24 positioned on the circulation junction of the heat transfer liquid source at 95° C. and the valve 25 for transmitting the liquid to the exchange zone from the source 111 at 65° C. are closed. On the other hand, the valve 26 positioned on the circulation junction of the heat transfer liquid source at 65° C. and the valve 23 for transmitting the liquid to the exchange zone from the source at 95° C. are open. The valve 118 for redirecting the liquid leaving the exchange zone is positioned so as to redirect the liquid leaving the chamber to the pipe 120 and the tank 110 located upstream of the thermalization system at 95° C.

Then, 40 cycles of temperature variation between 95° C. and 65° C., with an alternation of 5 s are performed in order to amplify the DNA contained in the sample by the PCR reaction. For the, the state of the valves 23, 24, 25, 26 and 118 is reversed every 5 s.

Example 3

In this example corresponding to FIGS. 7*a* to 7*d*, the micro-fluidic microchip 1 for temperature control comprises a cavity of the same geometry as in Example 2. It comprises 4 ports 2, 3, 16, 17 and makes it possible to switch two heat transfer liquids 112 and 114 at different temperatures between the heat exchange zone 22 and two circulation junctions by means of four integrated valves 23, 24, 36 and 37. It is made out of a polycarbonate piece formed from a sandwich of two micro-machined (CNC) polycarbonate pieces, then glued by hot melting or assisted by a solvent by well-known methods in the plastics industry, which makes it possible to create channels inside the polycarbonate piece, while avoiding their contact with the aluminum layer, which limits the heat exchange parasites with the thermalization zone (22). On the surface of this polycarbonate piece on the cavity 202 is fixed (preferably glued) an aluminum sheet 41 of 500 μm in thickness by pressing, which enables to seal the cavity and to ensure the heat exchange with the sample. Advantageously, this aluminum sheet preferably does not cover the entire surface of the chip, but only the thermalization zone 22, (slightly protruding from it) in order to limit thermal losses by conduction along the sheet. The valves 24, 26, 36, 37 used are base-mounted-type miniature valves directly fixed on the chip to prevent any channeling out of the chip. The chip is supplied by two tanks and two pumps according to a pattern identical to that in Example 2 except that the valve 118 in Example 2 is replaced by a valve 37 integrated in the chip and the recirculation channels 119 and 120 are partially integrated in the chip, which has the advantage of being less bulky, cheaper to achieve, of limiting heat loss and of increasing the reliability of the system by reducing the number of fluid connectors.

In addition, a "3/2" valve 36, which replaces the valves 23 and 25 in Example 2, makes it possible to switch the source of liquid entering the chip through the inlets 2 and 3 towards the thermalization zone 22, which makes it possible to minimize the distance L by the use of a single space-saving valve positioned closest to the inlet orifice for the fluid 10. The assembly is controlled by a computer sequencing the different valves according to the liquid and the desired injection duration.

To carry out a PCR analysis with a system as described in FIG. 7, a cartridge is preferably used as described in Example 2. The sample is first thermalized at 95° C. for 30 seconds by circulating the heat transfer liquid thermalized at 95° C. by the on-line temperature controller while the heat transfer liquid thermalized at 65° C. is redirected to the circulation junction. To do this, the valve 36 positioned so as to circulate the liquid from the heat transfer liquid source at 95° C. entering through the inlet 2, while the valve 24 is in the closed position so as to block the recirculation of the liquid at 95° C. though its bypass way. At the same time, the valve 26 is opened for recirculating the liquid at 65° C. through the bypass way and the valve 37 is positioned so that the liquid from the thermalization zone 22 is redirected to the pipe 120 and the tank 110 located upstream of the thermalization system at 95° C.

Then, 40 cycles of temperature variation between 95° C. and 65° C., with an alternation of 5 s, are performed in order to amplify the DNA contained in the sample by the PCR reaction. For this, the state of the valves 23, 24, 25, 26 and 118 in FIG. 6 (24, 26, 36, 37 in FIG. 7*a*) is reversed every 5 s.

Figure 8A:
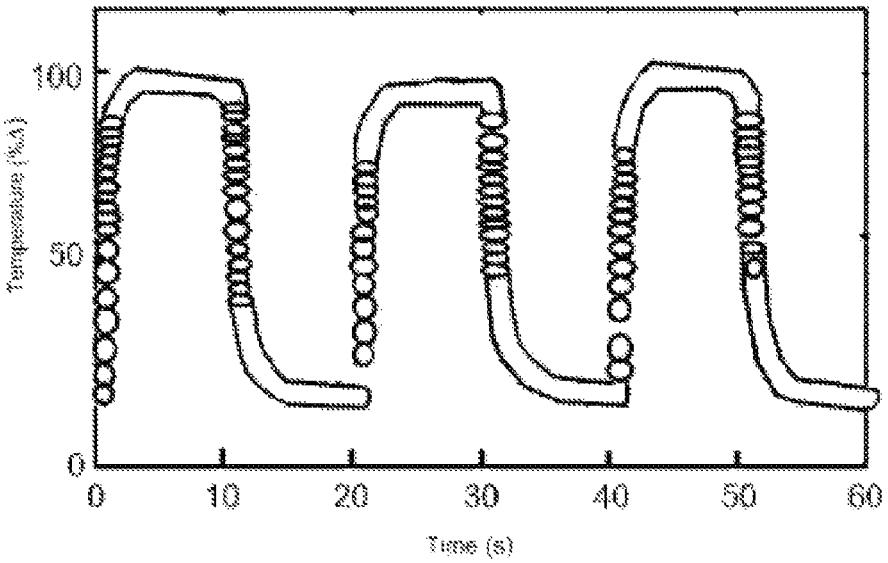
FIGS. 8*a* and 8*b* show the realization of a PCR cycle and the resulting fluorescence signal.

FIG. 8*a* shows the results measured with a thermal imaging camera and expressed as % of total change in temperature: it is found that the sample temperature reached 95% of the set temperature value after about 1.5 s.

Figure 8B:
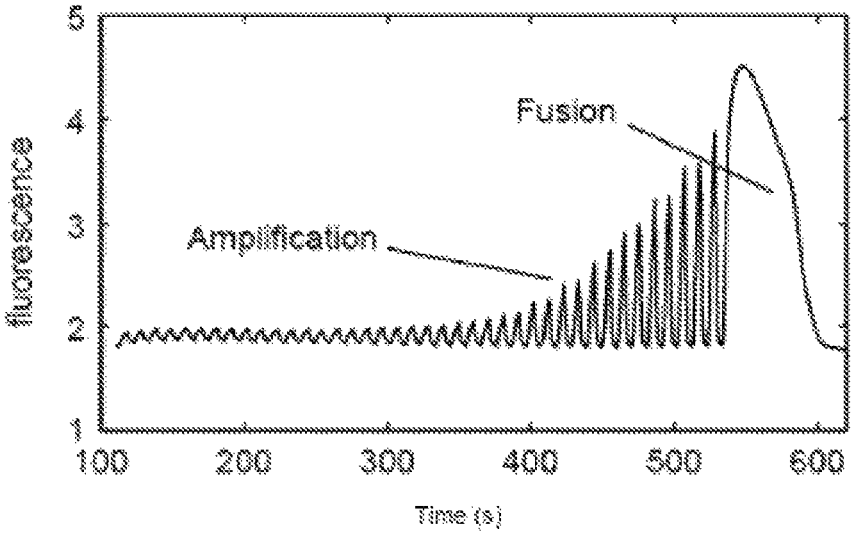

After 40 cycles, the system according to the invention is configured so as to continuously circulate the heat transfer liquid 114 at 65° C. in the thermalization zone 22, then the temperature of the liquid 114 of the source is gradually increased (until 85° C.) linearly over time so as to achieve what is commonly called by those skilled in this type of analysis, "a melting curve", i.e. a curve establishing the correspondence between the temperature and fluorescence level of the sample. This curve makes it possible to check the hybridization temperature of the amplified sequence, this information being used as a quality control of the PCR reaction. The fluorescence signal obtained is shown in FIG. 8*b* in which the progressive amplification over time of the fluorescence signal is clearly visible, followed by the melting curve.

Figure 9:
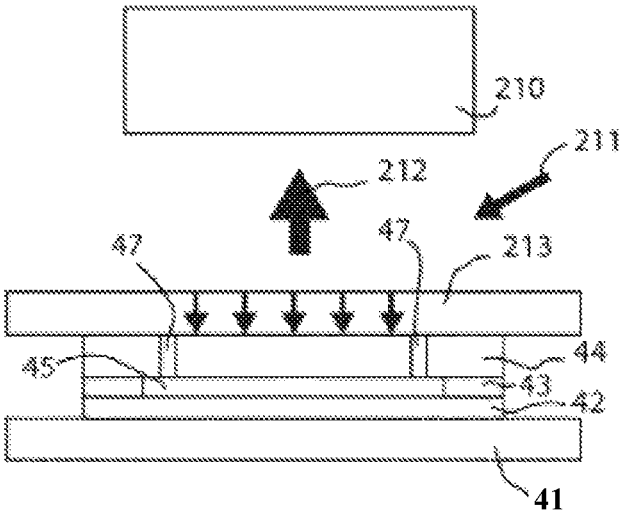
FIG. 9 shows a diagrammatic sectional view of a sample chip according to the second aspect of the invention.
Figure 11:
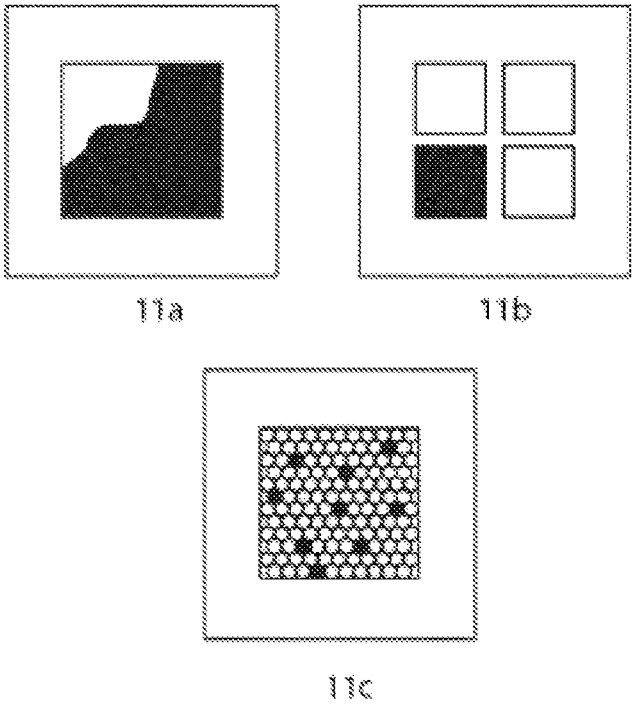

The system according to the second aspect of the invention includes, as diagrammatically represented in FIG. 9 a consumable container or a micro-fluidic sample chip for performing rapid real-time PCR reactions. The sample chip can contain one or more chambers (FIG. 11) in which real-time PCR reactions are carried out. It comprises two walls 42 and 44 with parallel outer sides, one of which 42 (lower side) is intended to allow the control of the temperature of a sample and its eventual reagent placed in the reaction chamber 45 and the other 44 (upper side) is intended to the optical measurement, including fluorescence. To allow a good temperature transfer between the thermalization film 41 and the sample and the reagent, it is preferable that at least one of the following conditions (preferably several and more preferably all of them) is fulfilled:

1. the consumable contain is maintained in contact with the thermalization film at a pressure greater than or equal to 5000 Pa (50 mBar), but preferably greater than or equal to 100000 Pa (1 Bar) (average pressure on the contact surface);

2. the reaction chamber is sealed so as to withstand a pressure at least equal to 50000 Pa (500 mbar), preferably greater than or equal to 100 000 Pa (1 bar) or is maintained pressurized artificially (outside) with means for pressurizing at a pressure greater than or equal to 5000 Pa (50 mBar), preferably greater than or equal to 50000 Pa (500 mBar). In this way, the heat transfer between the sample and the thermalization film can be done in good conditions;

3. the heat conducting layer between the reagent and the thermalization film is sufficiently conductive, that is to say greater than or equal to 15 $w \cdot m^{-1} \cdot K^{-1}$, preferably greater than or equal to 100 $w \cdot m^{-1} \cdot K^{-1}$ and is not made of a PCR inhibiting material, such as for example aluminum or its derivatives;

4. the wall and the upper side of the sample chip intended to enable the optical measurement is made out of a material having a thermal conductivity preferably less than or equal to 1 $w \cdot m^{-1} \cdot K^{-1}$ and preferably an effusivity lower than or equal to 1000 $J \cdot m^{-2} \cdot K^{-1} \cdot s^{-0.5}$, preferably transparent for the visible wavelengths, preferably withstanding temperatures greater than or equal to 95° C. without deforming and preferably not being a PCR inhibitor, which may be for example a plastics material selected from polycarbonates and/or polymers and/or cyclic olefin copolymers COP, cyclic olefin copolymer COC and their derivatives. All these materials are well known to those skilled in the art of micro-fluidics (see, for example, the article of Rajeeb K. Jena et al.: "Cyclic olefin copolymer based micro-fluidic devices for biochip applications: Ultraviolet surface grafting using 2-methacryloyloxyethyl phosphorycholine"); and 5. The heat conducting layer between the reagent and the thermalization film is sufficiently thin (<=500 μm, preferably <=300 μm) so that its surface can conform to the surface of the thermalization film under the effect pressure, in particular, in the thermalization chamber.

Advantageously, the thermalization film 41 can use a heat transfer liquid allowing a rapid temperature transfer (less than or equal to 5 s.) As described, in particular, in the first aspect of the invention.

Figure 10:
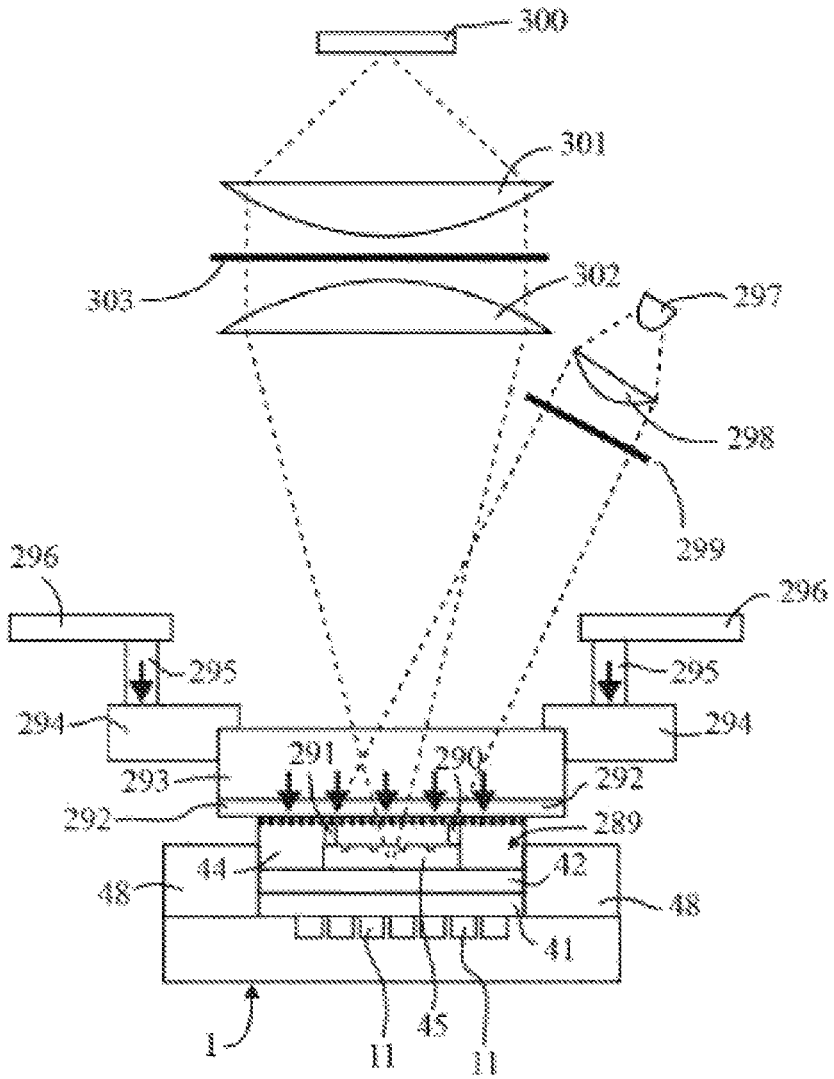
FIG. 10 shows an exemplary embodiment of a system according to the second aspect of the invention, comprising particular optical measurement means, FIG. 11 show various representations of single or multi-chamber sample chips, containing a sample or sample drops.

The pressurizing means 213 for the chip on the thermalization film 41 may be formed for example by a transparent glass piece (293) which is pressed on the chip by means of springs supported by a frame (294, 295, 296) and applying sufficient pressure on the chip (see FIG. 10). A slide mechanism (not shown) is for example provided to lift the frame and thus provide access to the space provided for the chip in order to place it before the implementation of the reaction or after implementation thereof.

But the pressurizing means can now also be a frame maintaining a pressure on the periphery of the chip (if it is sufficiently rigid) in order to avoid the deformation thereof under the effect of the pressure in the reaction chambers.

The sample chip can comprise a single chamber 45 (FIG. 11*a*): in this implementation mode, the optical measurement using the means 210 and the light source 211 can be made with a simple avalanche-diode-type sensor on which the light from the chamber 45 is refocused. This configuration has the advantage of allowing a measurement with an equal sensitivity on all the surface of the chamber, the signal generated by the sensor being proportional to the increase in fluorescence in the chamber, even if it is not the case for the distribution of the fluorescence in the chamber, for example when a low copy number of target DNA is initially present. A camera can also be used as a sensor, which measures the fluorescence homogeneity in the chamber for focusing purposes or for controlling the reaction homogeneity on the surface of the chamber. In this case, the sensor used will advantageously be of sCMOS technology, which provides a high sensitivity and a low signal-to-noise ratio for low exposure times, so as to follow, if necessary, in real time, the fluorescence signal. The introduction of the sample and the reagent into the reaction chamber 45 is carried out via the openings 47 shown here in the transparent upper wall 44: but at least one of these openings can be made through the side walls 43 of the sample chip which can have a rectangular or square or cylindrical parallelepiped shape. After introducing the sample, the openings 47 are preferably closed with a sealing adhesive.

FIG. 10 schematically shows the device and the chip forming the system according to the second aspect of the invention and described in Example 4 below.

The sample chip in FIG. 11*b* includes four chambers (or more if necessary); each chamber can, in particular, contain a different PCR reagent, the various test conditions in the different chambers can be compared under the same temperature conditions. In this case, the detection can be carried out with a sensor matrix having the same spatial organization as the chambers and on which the image of the chambers (four sensors in FIG. 11*b*) or a camera sensor can be refocused, as previously described.

FIG. 11*c* shows another mode of implementation with a single chamber for performing a PCR on droplets of sample for performing a so-called "digital" PCR. A camera is then used to film the reaction in the droplets.

In all the FIGS. 11*a* to 11*c*, black zones indicate the presence of fluorescence, indicative of a positive PCR reaction.

The following exemplary embodiments make it possible to illustrate, in particular, the second aspect of the invention described above:

Example 4

In this fourth example, the temperature control means for the samples contained in the micro-fluidic sample chip is a micro-fluidic thermalization chip in which two heat transfer liquids having two different temperatures (typically 65° C. and 95° C.) are caused to circulate alternately, as described above and in the manner shown in FIG. 4*a*.

Figure 7A:
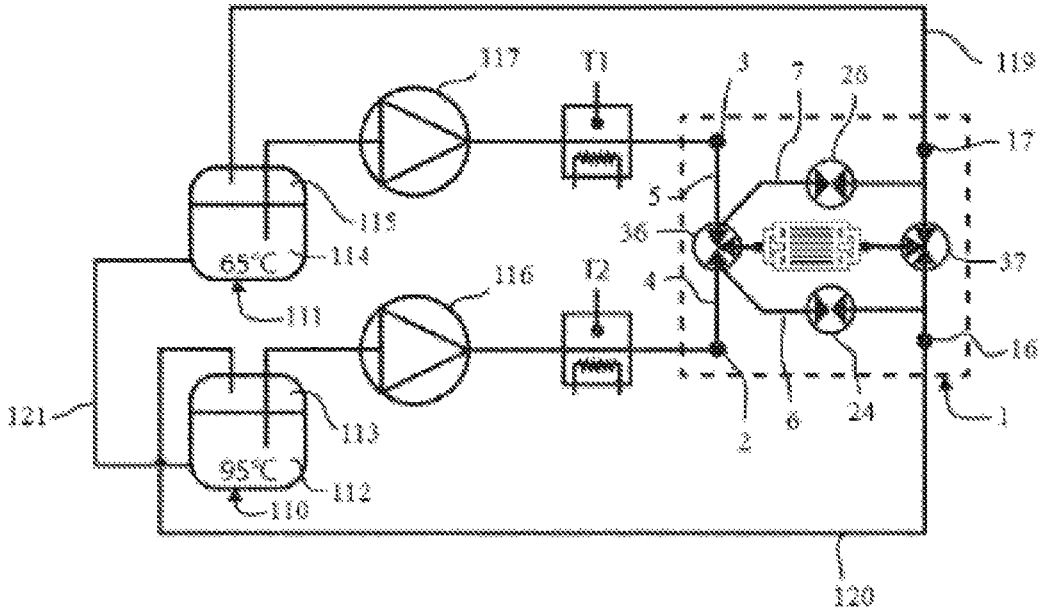
FIGS. 7*a* to 7*d* show another variant with a thermalization chip shown in three dimensions and equipped with miniature valves of the base-mounted type.
Figure 7B:
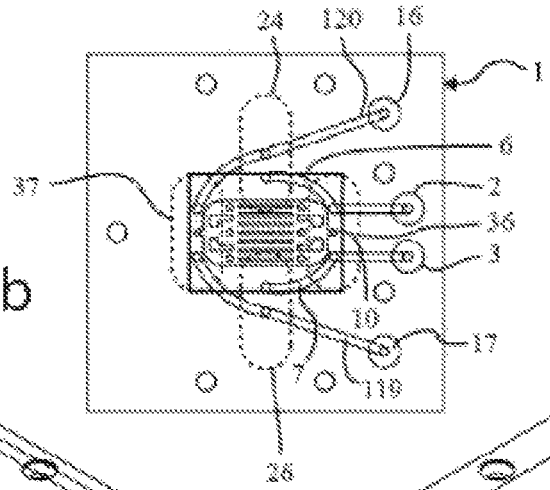
Figure 7C:
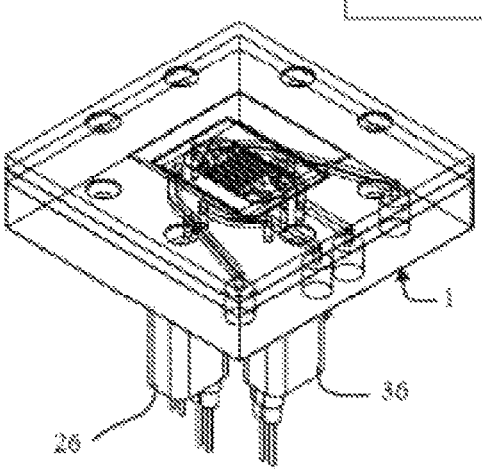
Figure 7D:
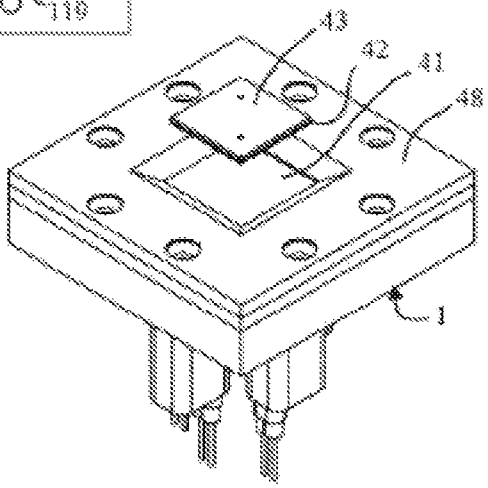

In FIG. 10, the sample chip 289 comprises for example a single chamber 45, which can be filled through two openings (an inlet port 290 for the sample and reagents and an air outlet port 291—or vice versa—see FIGS. 3*b*, 3*c* and 7*d*) by means for example of a pipette. It is formed by an aluminum film 41 to 200 μm in thickness for its lower wall and its heat conducting lower side and a transparent polycarbonate piece 44 in which the ports 290 and 291 (47 in FIG. 3*c*) for filling are drilled.

After filling, the openings 290, 291 of the sample chip are sealed with a silicone/polyester adhesive in order to maintain a pressure therein. The sample chip is then placed (FIG. 10) in a housing delimited laterally by a fastening frame 48 above the thermalization interface 41 (metal film) disposed above the thermalization chip 1 according to the first aspect of the invention and as described with reference to FIG. 3*c*. A lever system (not shown) used for example to lower a frame 296 on which a glass piece 293 mounted on four springs 294, 295 is fixed, which will apply a controlled and uniformly distributed pressure of 20N on the surface of the sample chip 289 once the system is engaged (equivalent to 100000 Pa (1 bar)). A thin layer 292 of transparent elastomer (so-called soft layer) is fixed under the glass piece 293 in order to homogenize the pressure on the surface of the chip and to avoid the detachment of the sealing adhesive in the openings 290 and 291.

An optical detector is mounted on the frame 296, comprising

- a LED diode 297 shifted to the right in the figure, in which the wavelength is adapted to the fluorescence excitation wavelength of the intercalating element Cybergreen commonly used (and added into the sample) for the measurement of real-time PCR. This LED 297 is directed to the reaction chamber 45 of the chip.
- a lens 298 for collimating the light emitted by the LED and producing a homogeneous excitation across the surface of the chamber 45.
- an excitation filter 299 for restricting to the desired value the spectrum of the light emitted by the LED.
- an optical sensor 300 placed above the chamber 45, having a square shape, of the MPPC type (of the company Hamamatsu) of 3×3 mm on which the image of the chamber is focused by means of two plano-convex lenses 301 and 302, positioned so that the projected image of the chamber does not extend beyond the surface of the sensor 300.
- an emission filter 303 adapted to measure the fluorescence of the intercalating element Cybergreen and compatible with the light spectrum delivered by the excitation filter 299, this emission filter 303 being positioned between the two lenses 301 and 302.

A data acquisition system (not shown in the figure) makes it possible to measure in real time the fluorescence signal delivered by the sensor 300. The system is implemented to perform 40 temperature cycles with an alternation of 5 s to amplify the DNA contained in the sample by PCR reaction.

After 40 cycles, the system is configured to gradually increase the temperature in a linear manner over time. This produces what is called in the PCR jargon a "melting curve" (FIG. 8), that is to say the correspondence between the temperature and the fluorescence level for the sample. This curve makes it possible to check the hybridization temperature of the amplified sequence, this information being used by those skilled in the art to control the quality of the PCR reaction. The fluorescence signal obtained is shown in FIG. 8*b*.

Example 5

This exemplary embodiment is in all aspects identical to Example 4, the chip sample comprises four chambers while the sensor is replaced with a sensor array 2×2 of the same type.

Example 6

In this example, the chip comprises a single chamber 45 and the sensor is a Hamamatsu C13770-50U sCMOS camera for observing the PCR chamber with high spatial resolution. The PCR is carried out in micro-droplets of 10 nL of reagents in Fluorinert FC-40 oil (Sigma-aldrich) which are produced by means of a suitable micro-fluidic device (for example the Droplet Generator Pack Elveflow) and are injected into the chamber 45. The amplification in each droplet can be observed in real time by the camera. The results obtained are similar to those obtained in FIG. 8.

These various examples show that the pressure applied simultaneously on the chip and in the chip (passively by the pressure naturally induced by the increase in temperature of the reagent or actively by the pressurization of the reagent) allows a good thermal contact between the aluminum sheet of the chip containing the sample and the aluminum sheet of the thermalization chip. Thanks, in particular to this good contact, it is possible to carry out rapid PCRs.

The invention claimed is:

1. A system to analyze PCR-type samples contained in at least one chamber of a micro-fluidic sample chip to test biological samples, for PCR or fluorescence analysis, in the form of a hollow block comprising said at least one chamber delimited by an upper wall, a lower wall and at least one side wall, into which a sample to be tested can be introduced;

wherein the block is provided with at least a lower side and an upper side parallel to each other, the lower side being disposed onto the lower wall, the upper side being disposed on the upper wall made of a material having a thermal conductivity lower than a material of the lower side and the upper side being permeable, at least in said at least one chamber, to radiations having a wavelength between 300 nm and 900 nm;

wherein the hollow block comprises at least two openings to introduce the sample into said at least one chamber and to discharge pressure in the chamber during the introduction of the sample;

the system comprising:

a thermalization film to increase or decrease, by a thermal cycling, a temperature of the micro-fluidic sample chip and the samples therein, in a thermal contact with the lower side of the micro-fluidic sample chip;

sealers to close said at least two openings in said at least one chamber to maintain a relative internal pressure of at least 5000 Pa (50 mbar) in said at least one chamber, an increase in the temperature of the samples causing said at least one chamber to expand, thereby improving the thermal contact between the lower side of the micro-fluidic sample chip and the thermalization film;

a pressure controller to maintain a relative external pressure greater than 50 mbar over the entire upper side of the micro-fluidic sample chip to provide a substantially uniform thermal contact between the lower side of the micro-fluidic sample chip and the thermalization film, wherein the upper wall of the micro-fluidic sample chip comprises a transparent portion traversed by light rays and located above said at least one chamber containing one of the samples;

an optical measurement instrument, comprising a camera, to optically observe the samples with a spatial resolution; and wherein the pressure controller is formed by a plate of transparent material associated with a frame arranged at a periphery of the plate and springs configured to apply a pressure onto the frame.

2. The system of claim 1, wherein the thermalization film utilizes a heat transfer liquid to provide a change in the temperature of the samples higher than or equal to 5° C./s.

3. The system of claim 1, wherein the pressure controller is configured to maintain the relative external pressure higher than 100000 Pa (1 bar) over at least one portion of the upper side of the micro-fluidic sample chip.

4. The system of claim 1, wherein the pressure controller is further formed by a housing having outer dimensions of the micro-fluidic sample chip to house the micro-fluidic sample chip therein at a room temperature, as the temperature of a sample trapped in said at least one chamber of the micro-fluidic sample chip increases, walls of the housing exert a pressure onto the upper and lower walls of the micro-fluidic sample chip.

5. The system of claim 1, further comprising an injector to introduce a sample into said at least one chamber of the micro-fluidic sample chip positioned in the system.

6. The system of claim 1 is configured to perform a polymerase chain reaction (PCR) including a digital PCR (dPCR) or a digital droplet PCR (ddPCR).

7. The system of claim 1, wherein the lower side is disposed onto the lower wall made of the material having the thermal conductivity greater than 15 $W \cdot m^{-1} \cdot K^{-1}$.

8. The system of claim 1, wherein the sealers are configured to maintain the relative internal pressure of at least 50000 Pa (500 mbar) in said at least one chamber.

9. A system to analyze PCR-type samples contained in at least one chamber of a micro-fluidic sample chip to test biological samples, for PCR or fluorescence analysis, in the form of a hollow block comprising said at least one chamber delimited by an upper wall, a lower wall and at least one side wall, into which a sample to be tested can be introduced;

wherein the block is provided with at least a lower side and an upper side parallel to each other, the lower side being disposed onto the lower wall, the upper side being disposed on the upper wall made of a material having a thermal conductivity lower than a material of the lower side and the upper side being permeable, at least in said at least one chamber, to radiations having a wavelength between 300 nm and 900 nm;

wherein the hollow block comprises at least two openings to introduce the sample into said at least one chamber and to discharge pressure in the chamber during the introduction of the sample;

the system comprising:

a thermalization film to increase or decrease, by a thermal cycling, a temperature of the micro-fluidic sample chip and the samples therein, in a thermal contact with the lower side of the micro-fluidic sample chip;

sealers to close said at least two openings in said at least one chamber to maintain a relative internal pressure of at least 5000 Pa (50 mbar) in said at least one chamber, an increase in the temperature of the samples causing said at least one chamber to expand, thereby improving the thermal contact between the lower side of the micro-fluidic sample chip and the thermalization film;

a pressure controller to maintain a relative external pressure greater than 50 mbar over the entire upper side of the micro-fluidic sample chip to provide a substantially uniform thermal contact between the lower side of the micro-fluidic sample chip and the thermalization film, wherein the upper wall of the micro-fluidic sample chip comprises a transparent portion traversed by light rays and located above said at least one chamber containing one of the samples;

an optical measurement instrument, comprising a camera, to optically observe the samples with a spatial resolution; and wherein the pressure controller is formed by a housing having outer dimensions of the micro-fluidic sample chip to house the micro-fluidic sample chip therein at a room temperature, as the temperature of a sample trapped in said at least one chamber of the micro-fluidic sample chip increases, said walls of the housing being configured to exert a pressure onto the upper and lower walls of the micro-fluidic sample chip.

10. The system of claim 9, wherein the thermalization film utilizes a heat transfer liquid to provide a change in the temperature of the samples higher than or equal to 5° C./s.

11. The system of claim 9, wherein the pressure controller is configured to maintain the relative external pressure higher than 100000 Pa (1 bar) over at least one portion of the upper side of the micro-fluidic sample chip.

12. The system of claim 9, wherein the pressure controller is further formed by a plate of transparent material associated with a frame arranged at the periphery of the plate and springs to apply a pressure onto the frame.

13. The system of claim 9, further comprising an injector to introduce a sample into said at least one chamber of the micro-fluidic sample chip positioned in the system.

14. The system of claim 9 is configured to perform a polymerase chain reaction (PCR) including a digital PCR (dPCR) or a digital droplet PCR (ddPCR).

15. The system of claim 9, wherein the lower side is disposed onto the lower wall made of the material having the thermal conductivity greater than 15 $W \cdot m^{-1} \cdot K^{-1}$.

16. The system of claim 9, wherein the sealers are configured to maintain the relative internal pressure of at least 50000 Pa (500 mbar) in said at least one chamber.

17. A system to analyze PCR-type samples contained in at least one chamber of a micro-fluidic sample chip to test biological samples, for PCR or fluorescence analysis, in the form of a hollow block comprising said at least one chamber delimited by an upper wall, a lower wall and at least one side wall, into which a sample to be tested can be introduced;

wherein the block is provided with at least a lower side and an upper side parallel to each other, the lower side being disposed onto the lower wall, the upper side being disposed on the upper wall made of a material having a thermal conductivity lower than a material of the lower side and the upper side being permeable, at least in said at least one chamber, to radiations having a wavelength between 300 nm and 900 nm;

wherein the hollow block comprises at least two openings to introduce the sample into said at least one chamber and to discharge pressure in the chamber during the introduction of the sample;

the system comprising:

a thermalization film to increase or decrease, by a thermal cycling, a temperature of the micro-fluidic sample chip and the samples therein, in a thermal contact with the lower side of the micro-fluidic sample chip;

sealers to close said at least two openings in said at least one chamber to maintain a relative internal pressure of at least 5000 Pa (50 mbar) in said at least one chamber, an increase in the temperature of the samples causing said at least one chamber to expand, thereby improving the thermal contact between the lower side of the micro-fluidic sample chip and the thermalization film;

a pressure controller to maintain a relative external pressure greater than 50 mbar over the entire upper side of the micro-fluidic sample chip to provide a substantially uniform thermal contact between the lower side of the micro-fluidic sample chip and the thermalization film, wherein the upper wall of the micro-fluidic sample chip comprises a transparent portion traversed by light rays and located above said at least one chamber containing one of the samples;

an optical measurement instrument, comprising a camera, to optically observe the samples with a spatial resolution; and wherein the sealers are configured to maintain the relative internal pressure of at least 50000 Pa (500 mbar) in said at least one chamber.

18. The system of claim 17, wherein the pressure controller is formed by a plate of transparent material associated with a frame arranged at the periphery of the plate and springs to apply a pressure onto the frame.

19. The system of claim 17, wherein the pressure controller is formed by a housing having outer dimensions of the micro-fluidic sample chip to house the micro-fluidic sample chip therein at a room temperature, as the temperature of a sample trapped in said at least one chamber of the micro-fluidic sample chip increases, walls of the housing exert a pressure onto the upper and lower walls of the micro-fluidic sample chip.

20. The system of claim 17, wherein the pressure controller is configured to maintain the relative external pressure higher than 100000 Pa (1 bar) over at least one portion of the upper side of the micro-fluidic sample chip.

* * * * *